US007988479B2

(12) United States Patent
Hankins et al.

(10) Patent No.: US 7,988,479 B2
(45) Date of Patent: Aug. 2, 2011

(54) BAYONET CONNECTOR

(76) Inventors: Christopher Michael Hankins, Santa Rosa, CA (US); Mark Kelly Mezey, Santa Rosa, CA (US)

( * ) Notice: Subject to any disclaimer, the term of this patent is extended or adjusted under 35 U.S.C. 154(b) by 0 days.

(21) Appl. No.: 12/386,831

(22) Filed: Apr. 22, 2009

(65) Prior Publication Data

US 2010/0273342 A1 Oct. 28, 2010

(51) Int. Cl.
*H01R 13/62* (2006.01)

(52) U.S. Cl. ..... 439/314

(58) Field of Classification Search ..... 439/314, 439/315–319, 312, 313
See application file for complete search history.

(56) References Cited

U.S. PATENT DOCUMENTS 1,304,075 A * 5/1919 Lofgen ..... 439/319
2,002,177 A * 5/1935 Hastings ..... 439/187
2,266,663 A * 12/1941 Sprague ..... 200/50.28
2,561,677 A * 7/1951 Souriau ..... 439/319
3,046,515 A * 7/1962 Appleton ..... 439/186
3,092,290 A * 6/1963 Hoelle ..... 222/385
3,393,927 A * 7/1968 McCrea et al. ..... 285/23
3,611,260 A * 10/1971 Colardeau et al. ..... 439/317
4,140,358 A * 2/1979 Marechal ..... 439/139
4,440,464 A * 4/1984 Spinner ..... 439/218
4,478,473 A * 10/1984 Frear ..... 439/312
4,488,765 A * 12/1984 Erbe ..... 439/137
5,431,580 A * 7/1995 Tabata ..... 439/289
7,455,542 B2 * 11/2008 Norwood et al. ..... 439/315

* cited by examiner

*Primary Examiner* — Neil Abrams
(74) *Attorney, Agent, or Firm* — Risto A. Rinne, Jr.

(57) ABSTRACT

An apparatus for detachably-attaching a first half of an electrical connector to a second half includes an exterior first half housing as part of the first half that rotates about a split ring with respect to a remaining interior portion of the first half. The interior portion does not rotate. The first half housing rotates during connection as the interior portion is urged longitudinally. Electrical sockets and electrical contact pins are provided in the first half and the second half. The first half housing includes inward-protruding pins that engage with outward facing slots of the second half and follow the contour of the slots as the first half housing is rotated causing a longitudinal displacement of the first half with respect to the second half. The slots and housing structure prevent flame propagation by providing complete electrical disconnection before a final mechanical release of the bayonet connection occurs.

18 Claims, 7 Drawing Sheets

BAYONET CONNECTOR

BACKGROUND OF THE INVENTION

1. Field of the Invention

The present invention, in general, relates to electrical connectors and, more particularly, to electrical connectors that are suitable for use in challenging environments.

There are many situations in which a connector must maintain connectivity and permit rapid disconnection when required while dealing with specific environmental challenges.

One such example occurs at oil and/or gas wells. It is necessary to supply electrical power to pumps and other electrical equipment that are disposed in oil and gas wells. The electrical connection occurs through the top of the well, commonly referred to as the "wellhead." Typically, an electrical cable is used to supply the requisite electrical power to the wellhead.

According to a prior art solution, attached to a proximate first end of the electrical cable is a first half of a prior art type of an electrical connector. The first half of the prior art electrical connector is attached by screw threads to a corresponding second half of a prior art type of an electrical connector. The second half of the prior art electrical connector is attached to a feed-through disposed in the wellhead. The feed-through provides a physical connection that is mechanically secured to the wellhead and it also provides an electrical connection that interfaces at the top with the conductors of the cable and at the bottom with the conductors of an inner cable that is disposed in the well and which extends down the well to the pump or other equipment that is disposed inside of the well.

The prior art first half of the electrical connector (which is attached to the cable) includes inside screw threads and a plurality of electrical sockets. The prior art second half of the electrical connector includes outside screw threads and a plurality of electrical pins that mate with the electrical sockets.

There are various times when it becomes necessary to disconnect the electrical cable from the wellhead, for example, when servicing the pump or other equipment that is disposed in the well. A standard procedure exists for disconnecting the electrical cable from the wellhead which requires that electrical power first be removed from the cable prior to any attempt to physically disconnect the cable from the wellhead.

A circuit breaker or other type of electrical switch that supplies electrical energy to a distal second end of the cable is turned off at a location remote from the wellhead. After ensuring that electrical power is not supplied to the cable, an operator will begin to unscrew the first half of the electrical connector apart from the second half of the electrical connector. The process of removing the first half of the connector from the wellhead takes a considerable amount of time and the lessening of this time is an important object of the instant invention.

The ambient environment proximate the well can be potentially explosive. Volatile ambient gases and a quantity of oxygen may be present and comingle in proportions that could combust, if ignited. Although very unlikely, it is possible that these gases could enter into the electrical connector during disconnection and, if ignited, result in an undesired forced separation of the connector halves and possibly even an igniting of the surrounding ambient atmosphere.

This type of an environment as well as other similar environments is sometimes referred to in the electrical connector industry as being either hazardous or potentially explosive.

Electrical connectors used in such an environment are frequently required to be certified as compliant to an appropriate standard, for example, to a relevant part of the National Electric Code (NEC), by any of the various testing agencies that verify compliance with domestic and/or international standards for use in hazardous environments. The testing and verification of the compliance of electrical connectors with a particular standard is well-known throughout the world and is not discussed in detail herein.

The particular standard that the electrical connector needs to comply with depends on where the connector is to be used. For example, ATEX approval is required for use in Europe whereas certification to ensure NEC compliance is required for use in the U.S. IEC also provides standards that are relevant to electrical connector design.

An electrical connector that is compliant with the above NEC standard is typically referred to as being an "explosion proof" type of connector whereas if the electrical connector were compliant with the above ATEX standard it would typically be referred to as a "flame proof" type of connector. Other generic language, such as the electrical connector being suitable for use in a "hazardous location" may also be included as a part of any particular standard or other generic language may be used by those who are skilled in the electrical connector arts when referring to these types of electrical connectors.

The instant invention is intended to meet or exceed the above certification standards as well as any other applicable industry standard, domestic or international, governing any class, category, or rating for which the instant electrical connector can be used or modified for use. As is discussed in greater detail herein, it is expected that the broader teachings disclosed herein will be modified and adapted to provide electrical connectors with advantages and improved performance capabilities that are suitable for use in a variety of applications and environments not specifically mentioned herein. In general, all versions and modifications of the instant invention are expected to be designed to meet the governing standards for the application at hand.

What is especially significant to note is that prior types of electrical connectors which have been able to satisfy the appropriate standards for use in a hazardous or potentially explosive environment have all relied on a screw thread type of connection between the electrical connector halves. There has previously been no known way to provide an electrical connector for use in a hazardous or explosive environment, such as at an oil wellhead, that includes a bayonet type of connector and which is able to comply with the applicable standards governing use in a hazardous or explosive environment.

Most of the generally accepted industry standards that an electrical connector is required to comply with if it is used in a hazardous or explosive environment also require the electrical connector to contain combustion that may occur within the electrical connector, however unlikely that may be, within the confines of the electrical connector itself. In this way any combustion that might occur in the electrical connector is prevented from reaching the ambient atmosphere which surrounds the electrical connector.

It is unlikely that the atmosphere which surrounds the electrical connector would also contain a combustible or a potentially explosive mixture of gases and, if it did, that such a condition would not be detected by the operator. Because it remains a possibility, however remote, the applicable standards for use in a hazardous or potentially explosive environment are designed to help prevent combustion of the ambient environment from occurring as a result of any unlikely combustion occurring in the electrical connector during a disconnection of the two connector halves.

In the relevant electrical connector industry, the propagation of combustion (i.e., of a flame) from its point of origin in the electrical connector which travels to a location that is remote from the point of origin, such as to the ambient atmosphere or to another location within the electrical connector, occurs along what is commonly referred to as a "flame path". The design of prior art electrical connectors for use in an explosive or hazardous environment have found that by controlling certain tolerances along a potential flame path it is possible to limit the extent of propagation of combustion occurring inside the connector.

This has been accomplished with prior art electrical connectors by the simultaneous control of two important tolerances. The ability to control these two tolerances has not heretofore been possible with a bayonet type of connection and this inability is a significant reason as to why all prior art electrical connectors for use in a hazardous or explosive environment have relied upon screw threads. Another prior art reason for using screw threads in these environments relates to mechanical strength, and this is discussed in greater detail below.

It has been determined that by restricting a gap tolerance between the cooperating screw threads to an amount which is equal to or less than a maximum gap tolerance between the cooperating screw threads while also ensuring that that the maximum gap tolerance is maintained for at least a predetermined length, that the continued propagation of combustion along the flame path is stopped.

To accomplish the above safety requirements for use in an explosion-proof environment, a careful machining of predetermined areas of the first half electrical connector and second half electrical connector is required such that there exists both appropriately limited diametrical clearances on any non-threaded features as well as appropriately machined (pitched) threaded areas.

As an example, an "Explosionproof" connector adhering to the NEC CLASS 1 DIVISION 1, GROUP C standard (as defined by standard FM 3615) would be:

"... enclosed in a case which is capable of: 1) withstanding an internal explosion of a specified gas or vapor-in-air atmosphere; 2) preventing the ignition of a specified gas or vapor-in-air atmosphere surrounding the enclosure due to sparks, flashes or internal explosion; and 3) operate at temperatures which will not ignite the surrounding atmosphere ...."

By limiting the above predetermined flame path areas per their respective specifications, any flame arising from a combustion occurring inside the connector that would attempt to propagate along a potential flame path as provided by the predetermined diametric clearance area or the screw threads (i.e., a mating of the first half electrical connector and second half electrical connector) would be extinguished by any travel that is over 6 mm or five threads respectively. Accordingly, the flame would not be able to reach the ambient environment providing the first half electrical connector and second half electrical connector remain attached to each other.

The rapid increase in pressure that occurs as a result of combustion inside the electrical connector would exert a substantial force on the first half of the electrical connector attempting to separate it from the second half electrical connector. Separation prevention is provided by the previously cited minimum five threads of engagement (and by a snap ring that affixes the threaded coupling nut to the remainder of the first half electrical connector). Prudent safety factor engineering dictates that at least five threads of engagement between the first half of the electrical connector and the threads of the second half of the electrical connector be present at the moment of final electrical separation between the last of the contact power pins from its corresponding socket due to the probability that a spark may occur at this specific point during the separation.

Maintaining five revolutions of screw thread engagement is also helpful in providing the mechanical strength of connection necessary to retain the connector halves together in the unlikely event of an explosive type of combustion occurring in the electrical connector during separation of the connector halves.

Together, the need to contain propagation of the flame within the electrical connector and the need to provide sufficient mechanical strength and a type of mechanical connection that can prevent unwanted forced separation of the connector halves from occurring has compelled all prior electrical connectors that are designed for use in a hazardous or explosive environment to rely upon a screw thread connection between the electrical connector halves.

Of course, the entire connection or disconnection process of the electrical connector with respect to the wellhead is accomplished by the operator while also relying closely on a detailed connection and disconnection procedure that has been developed to further improve safety. In this manner, the likelihood of ignition occurring during disconnection of the electrical connector is highly unlikely.

Additionally, the established procedures for the operator also help to ensure that during connection the first half of the connector is fully and properly mated with the second half while also helping to ensure that the electrical connector is not over tightened.

A common method of determining that the first half of the electrical connector is fully mated to the second half includes a marking that is provided on the second half. The marking is obscured to some degree when the first half is fully tightened to the second half. In some installations it may be difficult or impossible to observe the marking. Therefore, it is possible for the operator to either over tighten or under tighten the first half of the electrical connector with respect to the second half of the electrical connector. It is also important to note that the operator does not receive any clearly discernible tactile or audible indication regarding installation when using any of the prior art types of explosion-proof electrical connectors.

It is important to note that for other potential uses of the instant electrical connector, such as for any particular application or environment other than that described herein for a preferred embodiment appertaining to use in oil and/or gas wells, that the standard or standards which regulate the dimensions or tolerances of the preferred embodiment are, of course, no longer utilized. For other applications, the dimensions and tolerances (and all other attributes) of the electrical connector are modified to comply with the requirements of the application at hand and the requirements of any applicable governing standard.

Heretofore, there has been no known way to overcome the above limitations associated with prior art electrical connectors for use in a hazardous or explosive environment that rely on a screw thread connection nor has there been any way to adapt a bayonet connector for use in such an environment.

It is especially important to note that the instant electrical connector is able to comply with standards (such as for use in a "hazardous location") that no previously designed bayonet type of electrical connector has been able to meet.

It is also to be understood that the instant invention can be modified for use in other environments, for example in environments that are not as severe as those described herein or, alternately, in environments that are even more severe or demanding. Those having ordinary skill in the electrical connector arts after having had benefit of the instant disclosure will be able to modify tolerances or other characteristics, as needed, to permit use of the instant invention in a variety of applications that stand to benefit the advantages and benefits that are provided by the instant invention.

The above critical application requires both flame path attenuation and prevention of an undesired forced separation of the connector halves from occurring in the event of an unwanted condition, such as combustion inside the connector. The instant invention provides these capabilities in a bayonet type of connector that can be modified to provide additional benefits and capabilities.

For example, there are applications where a bayonet connector would provide advantages over other types of connectors, for example, those that attach with screw threads where flame path attention is not a need, however, where there is a strong need to maintain connectivity even in the unlikely event of an inadvertent release of the bayonet connection. Applications that may subject the electrical connector to high levels of vibration pose a risk of inadvertent release as would also occur when there is a possibility of inadvertent contact by the connector with human or other traffic or by objects that might rotate the connector from a secured position into a loosened position.

Applications in the aerospace industry or military applications may similarly benefit from an electrical connector that maintains electrical connection even if it is inadvertently loosened. Such an electrical connector would also need to resist further loosening. Ideally, if such an inadvertent loosening were to occur, the electrical connector would provide indication, such as by a severed contact between a pin and a socket thereof, to provide an alert that an inadvertent separation had occurred.

A bayonet type of electrical connector that is able to provide any of the above-described benefits would represent an improvement over the current state of the art, including prior art screw thread types of electrical connectors and prior art bayonet types of electrical connectors.

While many of the above-described applications include a first half of an electrical connector that is attached to a cable and a second half of the electrical connector that is attached to an object, such as to the wellhead or to an instrument or other type of panel, there are also applications where one cable can be attached to another cable that can similarly benefit if a suitable bayonet type of connector is available. The instant invention is anticipated to be modified for use in a wide range of applications that can include attaching a cable to another cable or attaching a cable to a panel, instrument, or other device and for use in any conceivable environment.

Accordingly, there exists today a need for a bayonet connector that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and are not specifically mentioned herein.

Clearly, such an apparatus would be a useful and desirable device.

2. Description of Prior Art

Electrical connectors are, in general, known and have been described hereinabove. While the structural arrangements of the above described and known types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a bayonet connector that is easy to couple (i.e., to attach).

It is also an important object of the invention to provide a bayonet connector that is easy to decouple (i.e., to detach).

Another object of the invention is to provide a bayonet connector that can more quickly be coupled (i.e., be attached).

Still another object of the invention is to provide a bayonet connector that can more quickly be decoupled (i.e., removed).

Still yet another object of the invention is to provide a bayonet connector that includes a bayonet type of mechanical connection to physically secure a first half of the connector to a second half of the connector.

Yet another important object of the invention is to provide a bayonet connector that prevents a flame that occurs inside of the connector feed-through interface from propagating through the connector and reaching the ambient atmosphere that surrounds the connector.

Still yet another important object of the invention is to provide a bayonet connector that includes means for preventing unwanted separation of a first half of the connector from a second half of the connector.

A first continuing object of the invention is to provide a bayonet connector that increases durability and life-expectancy of the connector.

A second continuing object of the invention is to provide a bayonet connector that does not rely on screw threads for attachment of a first half of the connector to a second half of the connector.

A third continuing object of the invention is to provide a bayonet connector that prevents over-tightening of a first half of the connector from occurring with respect to a second half of the connector.

A fourth continuing object of the invention is to provide a bayonet connector that prevents under-engagement of a first half of the connector from occurring with respect to a second half of the connector.

A fifth continuing object of the invention is to provide a bayonet connector that provides tactile feedback to an operator to confirm that proper engagement (tightening) of a first half of the connector with respect to a second half of the connector has occurred.

A sixth continuing object of the invention is to provide a bayonet connector that provides audible feedback to an operator to confirm that proper engagement of a first half of the connector with respect to a second half of the connector has occurred.

A seventh continuing object of the invention is to provide a bayonet connector that provides a mechanical latch mechanism to secure a first half of the connector to a second half of the connector.

An eighth continuing object of the invention is to provide a bayonet connector that requires less than one revolution of a first half of the connector with respect to a second half of the connector in order to secure the first half to the second half.

A ninth continuing object of the invention is to provide a bayonet connector that requires less than one revolution of a first half of the connector with respect to a second half of the connector in order to disconnect the first half apart from the second half.

A tenth continuing object of the invention is to provide a bayonet connector that extinguishes and thereby prevents a flame occurring inside the connector from propagating through any of the slots in the connector and reaching an ambient atmosphere that is disposed outside of the connector.

An eleventh continuing object of the invention is to provide a bayonet connector that meets the requirements of any governing standard for which the connector is designed.

A twelfth continuing object of the invention is to provide a bayonet connector that includes a first half of the connector and a second half of the connector, and wherein the first half is able to rotate with respect to a second half, and wherein the first half includes a plurality of inward-protruding pins that mate with a plurality of slots that are provided in an exterior of the second half of the connector.

A thirteenth continuing object of the invention is to provide a bayonet connector that includes a first half of the connector and a second half of the connector, and wherein the first half of the connector includes a plurality of inward-protruding pins that mate with a plurality of slots that are provided in an exterior of a housing of the second half of the connector, and wherein each of the plurality of slots includes an overall contour that extends longitudinally and also around a portion of a circumference of the housing of the second half, and wherein an overall contour of each of the plurality of slots is identical with respect to an overall contour of a remainder of the plurality of slots, and wherein the slots include first means for preventing an initial inadvertent separation of the first half of the connector from occurring with respect to the second half of the connector when the first half of the connector is disposed in a fully secured position at an end portion of each of the slots, and wherein the slots include second means for preventing a final inadvertent separation of the first half from occurring with respect to the second half when the pins of the first half are disposed in a different and more centrally located portion of the slots.

A fourteenth continuing object of the invention is to provide a bayonet connector that can be modified to change the slot contour to provide other desired benefits, such as maintaining electrical connectivity in the even of a partial separation or inadvertent decoupling.

A fifteenth continuing object of the invention is to provide a bayonet connector that can be modified to ensure that electrical conductivity is maintained even if an undesired partial separation or decoupling occurs.

A sixteenth continuing object of the invention is to provide a bayonet connector that can be modified to include a lower curvature portion to the slots which functions as a first means for limiting an amount of separation that can initially occur during an undesired partial separation and that can ensure that electrical conductivity is maintained between a desired group of electrical contact pins and electrical sockets when the undesired partial separation or decoupling occurs.

A seventeenth continuing object of the invention is to provide a bayonet connector wherein a first half thereof is attached to a cable and wherein a second half thereof that cooperates with the first half is attached to any desired object including a panel, a motor, an instrument, a display, or another cable.

An eighteenth continuing object of the invention is to provide a bayonet connector that includes means for preventing unwanted separation of a first half of the connector from a second half of the connector in the event of a sudden rise in pressure that is occurring from a combustion that is taking place inside of the connector.

A nineteenth continuing object of the invention is to provide a bayonet connector that includes means for preventing unwanted separation of a first half of the connector from a second half of the connector in the event of an inadvertent release of the bayonet connector from its fully closed or latched position.

A twentieth continuing object of the invention is to provide a bayonet connector that includes means for preventing unwanted separation of a first half of the connector from a second half of the connector in the event of an inadvertent release of the bayonet connector from its fully closed or latched position and which is able to maintain electrical connectivity between at least one desired pin and socket in the event of such an inadvertent release.

A twenty-first continuing object of the invention is to provide a bayonet connector that includes means for preventing unwanted separation of a first half of the connector from a second half of the connector in the event of an inadvertent release of the bayonet connector from its fully closed or latched position and which is able to detect and provide an indication when an inadvertent release of the bayonet connector from its fully closed or latched position occurs.

Briefly, a bayonet connector that is constructed in accordance with the principles of the present invention has a first half of an electrical connector which mates with a corresponding second half of the connector. The first half is attached to a proximate first end of an electrical cable. The first half includes a first half housing. The first half housing functions as a coupling nut for connection to the second half. The first half housing includes a plurality of inward-protruding pins. The inward-protruding pins each align with and enter into one of a plurality of outward facing slots that are provided in the second half. The second half functions as a coupling adapter for detachably attaching of the first half housing thereto. The second half is attached to a panel, instrument, or other object such as a feed-through. The feed-through, according to one particular application, is attached to a wellhead of an oil or gas well. A spanner-type of wrench engages with one or more recesses that are provided in the first half housing. The spanner wrench is used to rotate the first half housing about a center longitudinal axis thereof. During engagement of the inward-protruding pins with the slots, when the first half housing is rotated relative to the second half, the inward-protruding pins follow the contour and curvature of the slots which results in a longitudinal displacement of the first half housing with respect to the second half, the direction of displacement (i.e., either inward or outward) depending on the direction of rotation by the first half housing. During tightening, the contour of the slots urges each of the inward-protruding pins of the first half housing, and therefore the first half of the electrical connector, simultaneously toward the second half until the first half housing is fully engaged, both mechanically and electrically, with the second half. During loosening, the contour of the slots urges the inward-protruding pins of the first half housing away from the second half until the first half housing is fully disengaged, both mechanically and electrically, from the second half. The first half housing rotates with respect to the electrical cable and therefore with respect to a plurality of electrical sockets that are disposed in the first half housing. First means are included in the contour of the slots and are used to prevent a first inadvertent separation of the first half of the electrical connector from the second half from occurring when the inward protruding pins are disposed in a fully secured (engaged) position at a lower end of the slots. Second means are also included in the contour of the slots and are used to prevent a second inadvertent separation of the first half from occurring with respect to the second half when the inward-protruding pins of the first half are disposed in a different, more centrally disposed portion of the slots. Together, the slots and inward-protruding pins create a bayonet-type of an electrical connector. Numerous benefits are provided by the instant invention over the prior art while adhering to industry-accepted standards such as for an explosion-proof type of electrical connector. Various modifications to adapt the instant invention for use in other applications are also described herein.

DETAILED DESCRIPTION OF THE INVENTION

Figure 2:
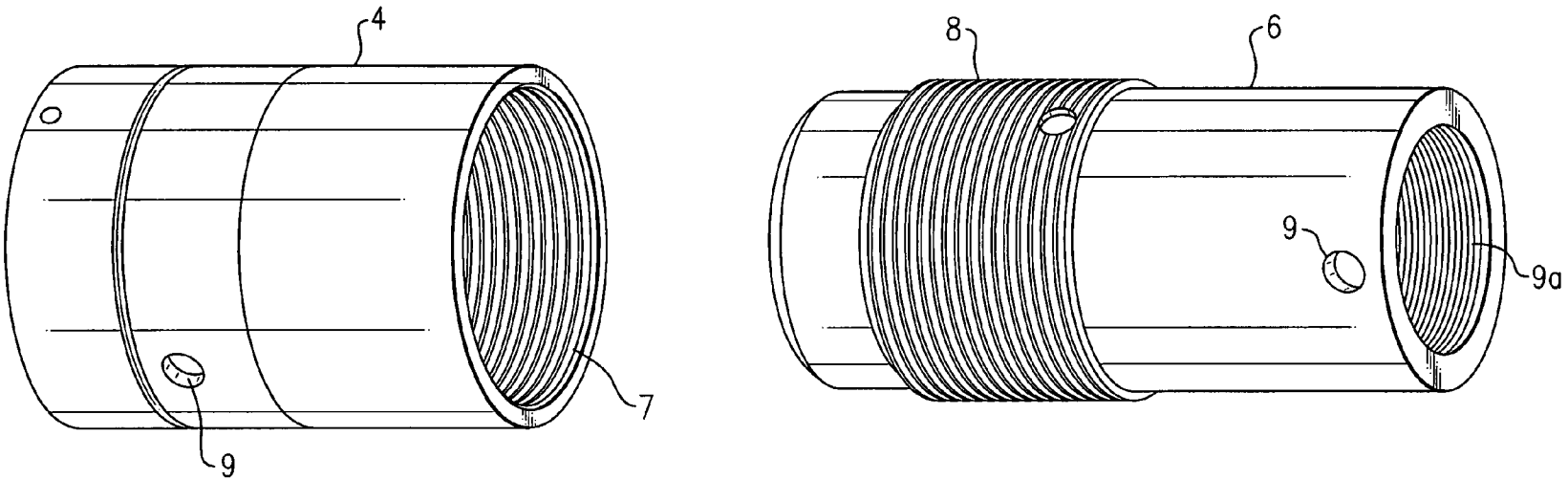
FIG.2 Prior Art
FIG. 2 is an exploded view in perspective of a prior art coupling nut and a prior art coupling adapter.

Referring initially to FIG. 2 is shown a prior art first half housing 4 and a prior art second half housing 6. Pins and sockets that are disposed therein are not shown. The prior art first half housing 4 attaches to a remaining portion of a first half of an electrical connector (not shown) and cable (not shown for the prior art). The prior art second half housing 6 attaches to a remaining portion of the second half of an electrical connector (not shown for the prior art) and to a feed-through at a wellhead (not shown for the prior art) of an oil or gas well (not shown for the prior art). If desired, the second half housing 6 can be machined and included as an integral part of the feed-through.

The feed-through and wellhead are not shown for use with the prior art. These, and various other components and/or assemblies which are adapted for use with either the prior art or with the instant invention, are introduced and described in greater detail hereinafter during a detailed description of the instant invention.

The prior art first half housing 4 functions as a coupling nut for detachably-attaching the prior art first half of the electrical connector to the prior art second half housing 6. Accordingly, the prior art second half housing 6 functions as a coupling adapter for cooperatively engaging with the prior art first half housing 4.

The prior art first half housing 4 includes inside threads 7 that cooperate with outside threads 8 of the prior art second half housing 6. Accordingly, to attach the prior art first half housing 4 to the prior art second half housing 6 (to provide both a mechanical and an electrical connection there-between), a spanner wrench (not shown) engages with a recess 9 that is provided in the prior art first half housing 4. The spanner wrench is used to tighten the prior art first half housing 4 to the prior art second half housing 6 or alternately, to remove the prior art first half housing 4 from the prior art second half housing 6 by rotating the prior art first half housing 4 about a center longitudinal axis thereof.

Figure 6:
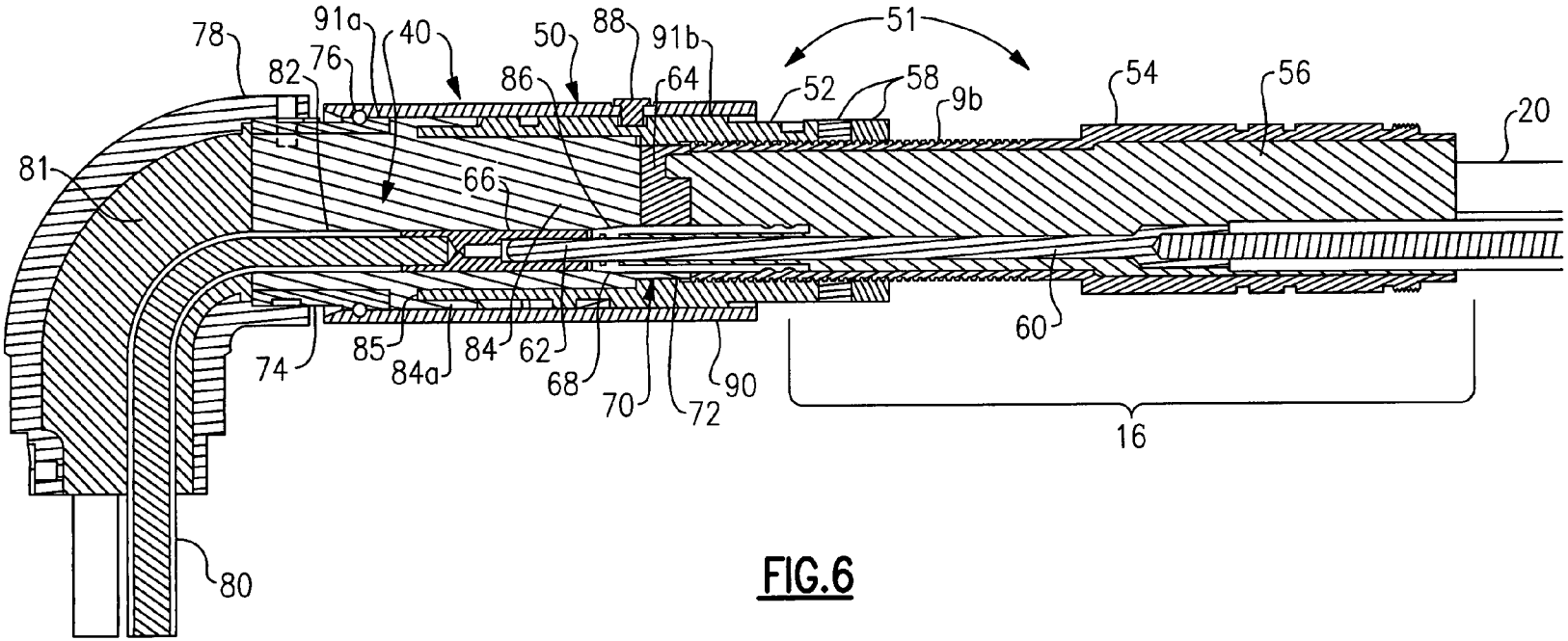
FIG. 6 is a cross sectional view taken on the line 6-6 in FIG. 1.

The prior art second half housing 6 includes distal inside screw threads **9*a* that are provided at an opposite end of the prior art second half housing 6 as are the outside threads 8 also provided in the prior art second half housing 6. The inside screw threads 9*a* cooperatively engage with outside screw threads (See 9*b*, FIG. 6**) of the feed-through.

Figure 1:
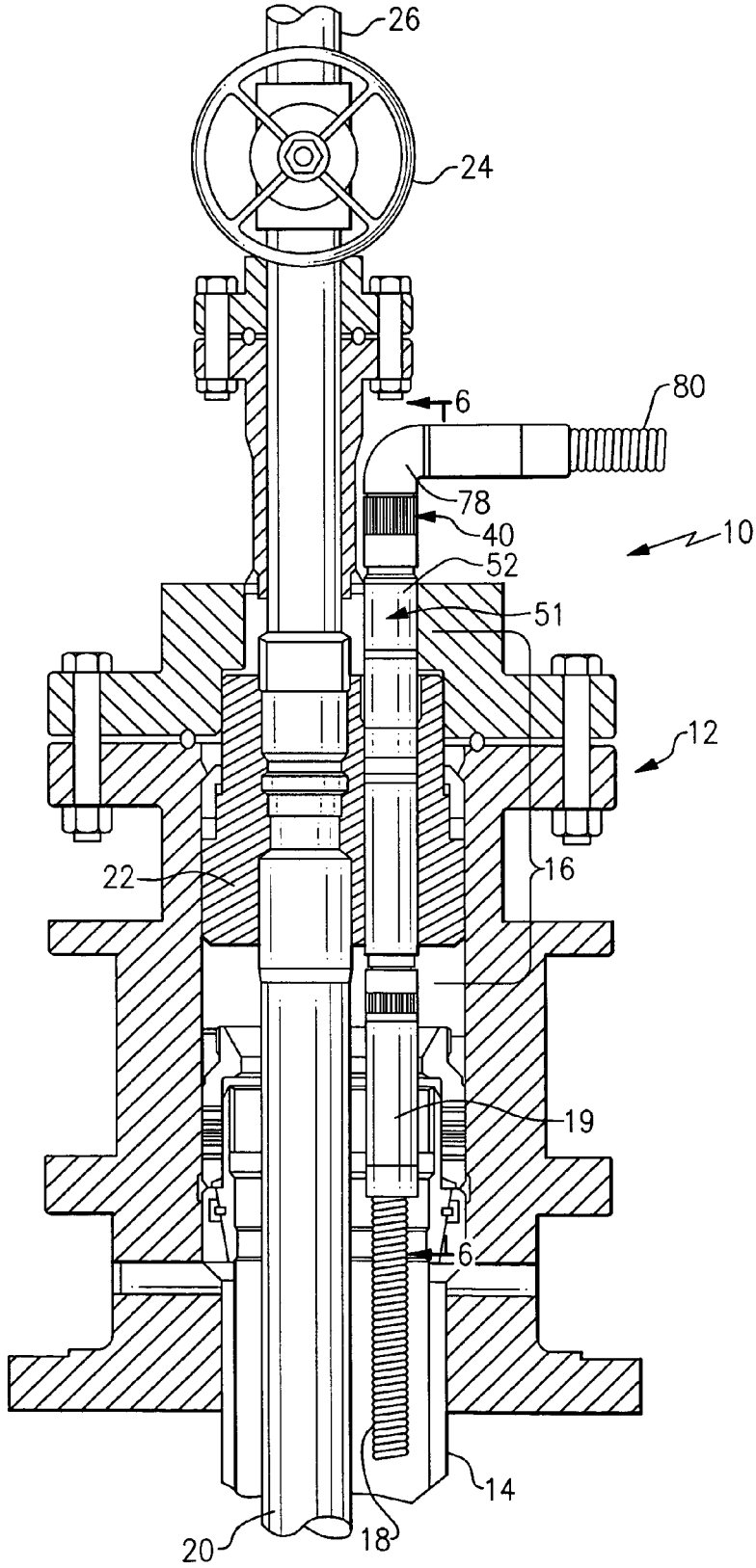
FIG. 1 is a cross-sectional view of a wellhead with a bayonet connector attached thereto.

Referring now to FIG. 1 is shown, a bayonet connector, identified in general by the reference numeral 10 that is attached to a wellhead, identified in general by the reference numeral 12 of an oil or gas well. A well casing 14 extends down from the wellhead 12 and into the ground any desired depth. The bayonet connector 10, as described herein, is for use in a potential explosive or hazardous environment.

This particular embodiment is selected as the preferred embodiment because it describes how the bayonet connector 10 can be used in especially difficult and challenging environments, the requirements of which all of the prior art types of the bayonet connector (4, 6) have not been able to satisfy. In this way, the bayonet connector 10 brings numerous benefits and advantages to these situations that have been previously unavailable. However, it is to be understood that the bayonet connector 10 can be modified for use in many other applications with similar or different challenges and requirements and that the resultant modified bayonet connector 10 would similarly bring numerous benefits and advantages to these other applications.

A feed-through, identified in general by bracket 16, is mechanically secured to the wellhead 12. The feed-through 16 provides an electrical connection through the wellhead 12 (with feed-through conductors therein, not shown in FIG. 1). The feed-through 16 provides both a mechanical and electrical connection to the bayonet connector 10 that is disposed at a top of the wellhead 12.

The feed-through 16 similarly provides both a mechanical and electrical connection to an inner cable 18 that is disposed in the casing 14 at a lower end of the feed-through 16. The inner cable 18 extends down a length of the casing 14 and connects to a pump (not shown) and/or to other equipment (not shown) that is disposed inside of the well, typically at or near a bottom thereof. An upper end of the inner cable 18 is attached to a lower connector 19. The lower connector 19 is attached to a bottom of the feed-through 16.

A production tubing 20 attaches at a bottom end thereof to the pump and extends up to the wellhead 12. A tubing hanger 22 supports the production tubing 20 and is attached to a segment of the production tubing 20. The tubing hanger 22 is mechanically secured to the wellhead 12 and provides the mechanical strength to support the weight of the production tubing 20. An upper end of the production tubing 20 is attached to a valve 24 and to an exterior conduit 26 that is used to convey oil or gas to a location away from the wellhead 12.

Figure 3:
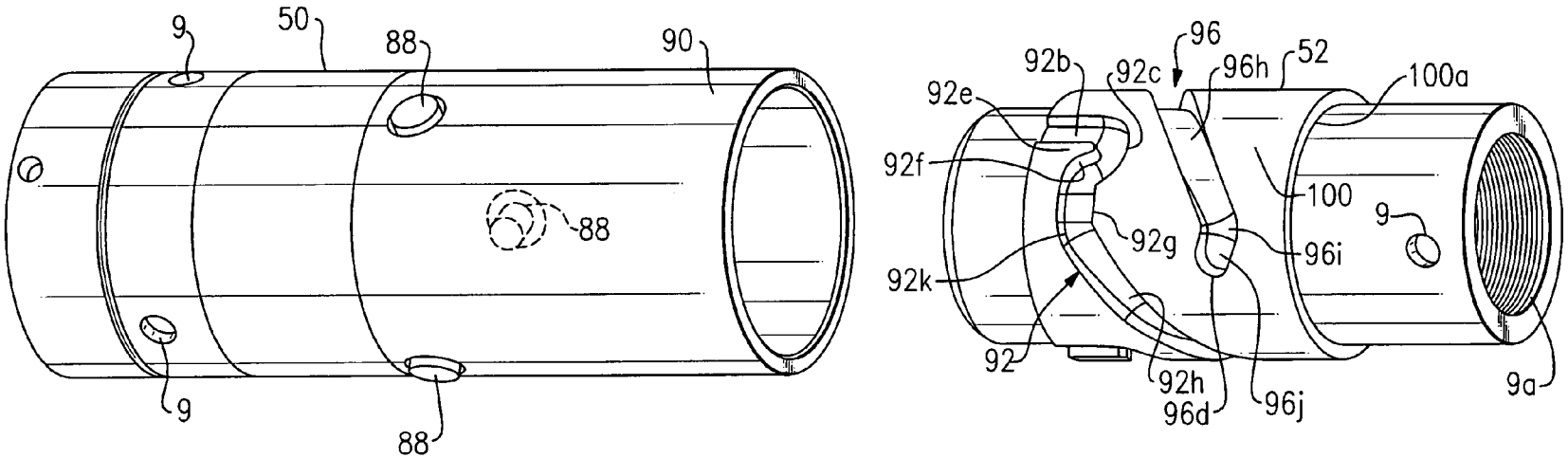
FIG. 3 is an exploded view in perspective of a coupling nut and a coupling adapter of the bayonet connector of FIG. 1.

Referring now also to FIG. 3 and on occasion to FIG. 4 through FIG. 7, the bayonet connector 10 includes a first half, identified in general (FIG. 6) by the reference number 40, that mates with a corresponding second half 52 of the bayonet connector 10. The second half 52 is attached by the inside screw threads 9*a* to an upper end of a feed-through housing 54. The feed-through housing 54 is included as a part of the assembly that comprises the feed-through 16. The inside screw threads 9*a* cooperate with outside screw threads 9*b* of the feed-through housing 54. The feed-through housing 54 is filled with a first quantity of epoxy 56. A pair of locknuts 58 secure the second half 52 to the feed-through housing 54.

A feed-through conductor 60 is included as an integral part of the feed-through 16. An upper end of the feed-through conductor 60 includes an electrical contact pin 62 that extends through a rubber seal 64 that is provided at a top of the feed-through 16. The electrical contact pin 62 extends beyond the rubber seal 64 and away from the feed-through 16.

A quantity of additional feed-through connectors (not shown) that are identical (or similar) to the feed-through conductor 60 and a quantity of additional electrical contact pins (not shown) that are identical (or similar) to the electrical contact pin 62 are included in the feed-through 16 and are disposed in a parallel spaced-apart relationship with respect to each other.

Figure 7:
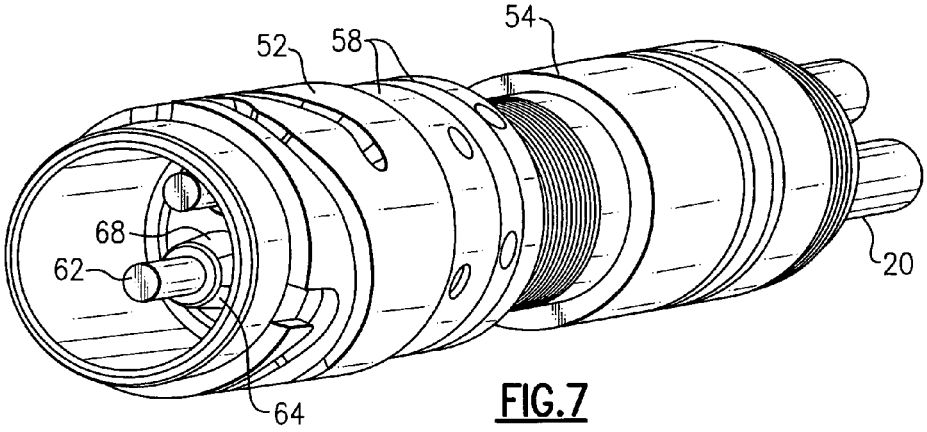
FIG. 7 is a view in perspective of the coupling adapter of FIG. 3 attached to a feed-through housing.

When the second half 52 is attached (by the distal screw threads 9*a*) to the feed-through 16, the quantity (i.e., only one shown) of the electrical contact pins 62 extend outward and are each adapted to mate with a corresponding electrical socket 66 (only one shown) that is included with the first half 40 of the bayonet connector 10 when the first half 40 is engaged with the second half 52. Referring also momentarily to FIG. 7, it can be seen that the quantity of the electrical contact pins 62 which extend outward from the feed-through 16 are disposed in an interior portion of the second half 52.

A base portion of each of the plurality of electrical contact pins 62 includes a portion of its overall exposed length that is disposed immediately above the rubber seal 64. The base portion of each of the electrical contact pins 62 is surrounded by a first portion 68 of a support cone, identified in general by the reference numeral 70. Each support cone 70 includes a second portion 72 that passes through the rubber seal 64 and is disposed in the first quantity of epoxy 56, to which it is secured. The support cone 70 and the second portion 72 are a continuous piece (i.e., they are not separate parts but part of the same piece and are provided with separate reference numerals only to show their relative positioning).

The first portion 68 of each support cone 70 includes a conical shape. The second portion 72 of each support cone 70 includes a cylindrical shape. Each support cone 70 is made of a material that is harder than the rubber seal 64, for example, a relatively hard and durable plastic.

The first half 40 includes a first half housing 50. The first half housing 50 is attached to a sleeve 74 by a retaining ring 76. It is desirable to maintain a tolerance of less than or equal to 0.002 inches prior to the retaining ring 76 to prevent the formation of a possible flame path for flame propagation. The tolerance is not necessarily maintained between the retaining (or snap) ring 76 and the groove provided in the sleeve 74 in which the retaining ring 76 is disposed. The tolerance between the retaining ring 76 and the groove can vary depending on the relative location of the retaining ring 76 in the groove. Flame propagation is discussed in greater detail hereinafter.

The first half housing 50, therefore, provides an exterior portion of the first half 40 that is able to rotate about a center longitudinal axis thereof with respect to the sleeve 74 and, accordingly, the first half housing 50 is able to rotate about its center longitudinal axis with respect to a remainder (or inner portion) of the first half 40 of the bayonet connector 10. This is important because it permits the inner portion or remainder of the first half 40 to be urged longitudinally while the first half housing 50 is rotated, thereby accomplishing a desired electrical connection between the electrical contact pins 62 and their corresponding electrical sockets 66 during attachment or a desired severing of the electrical connection during detachment of the first half 40 with respect to the second half 52.

The sleeve 74 is attached at an opposite end thereof to an elbow housing 78. The elbow housing 78 is attached to a first end of an electrical cable 80. A second quantity of epoxy 81 is disposed in the elbow housing 78.

Attached to the sleeve 74 and the elbow housing 78, a power conductor 82 extends from the electrical cable 80 and is disposed in the second quantity of epoxy 81 in the elbow housing 78. The power conductor 82 extends beyond the elbow housing 78 for a predetermined distance in a direction that is generally toward the feed-through 16. The power conductor 82 is attached and electrically connected to the electrical socket 66.

A portion of the power conductor 82 that is disposed in the first half 40 is surrounded by a cylindrical portion of rubber 84. A conical recessed portion 86 is provided in the cylindrical portion of rubber 84 at a distal end thereof, wherein the distal end is maximally disposed away from the elbow housing 78.

The electrical socket 66 is recessed within the cylindrical portion of rubber 84 so that a distal and open end of the electrical socket 66 is disposed within the cylindrical portion of rubber 84 prior to the distal end of the cylindrical portion of rubber 84, and at a beginning of the conical recessed portion 86. The beginning of the conical recessed portion 86 includes the smallest diameter thereof.

The conical recessed portion 86 progressively increases its diameter when traveling along a center longitudinal axis thereof toward the distal end of the cylindrical portion of rubber 84. The conical recessed portion 86 attains a maximum diameter thereof at the distal end of the cylindrical portion of rubber 84.

The conical recessed portion 86 provides a cone-shaped opening just prior to the open end of the electrical socket 66 that corresponds to the shape of the first portion 68 of the support cone 70, except that the conical recessed portion 86 includes a volume that is slightly smaller than the volume of the first portion 68 of the support cone 70.

Accordingly, when the first half housing 50 is used to urge the first half 40 and, accordingly, the electrical socket 66 into engagement with the electrical contact pin 62, the first portion 68 of the support cone 70 enters into the conical recessed portion 86 and, as it is further urged therein, the first portion 68 of the support cone 70 creates an interference fit with the surrounding rubber of the conical recessed portion 86 that compresses some of the cylindrical portion of rubber 84 that surrounds the conical recessed portion 86.

In addition to providing a tight fit that helps to prevent the entry of volatile gases into the bayonet connector 10, an additional important benefit is provided by the interference fit and is discussed in greater detail hereinafter. It is to be generally understood that all aspects of construction of the bayonet connector 10 (and of all surrounding structures or assemblies which cooperate with the bayonet connector 10) are designed to help prevent the possible entry of volatile gases therein.

As desired, there are additional electrical sockets (not shown) included in the first half 40 with each additional electrical socket being identical to or similar to the electrical socket 66. Each additional electrical socket is, of course, connected to a corresponding additional power cable (not shown) with each additional power cable being identical to or similar to the power conductor 82. The total number of electrical sockets 66 (including all additional electrical sockets) of the first half 40 is equal to the total number of contact pins 62 (including all additional contact pins) that are included in the second half 52.

The cylindrical portion of rubber 84 secures the electrical sockets 66 and power conductors 82 in position and to the sleeve 74. The sleeve 74, the cylindrical portion of rubber 84, the electrical sockets 66, the power conductors 82, and the first half housing 50, as an assembly, comprise the first half 40 of the electrical connector 10.

The electrical contact pins 62, the support cones 70, and the rubber seal 64, along with the feed-through 16, together as an assembly, form the second half 52 of the electrical connector 10.

The first half housing 50 functions as a coupling nut and is used to urge, and also to secure, the first half 40 of the bayonet connector 10 to the second half 52. Similarly, the second half 52 functions as a coupling adapter and is correspondingly used to receive and cooperate with the first half housing 50, thereby providing a detachably-attachable mechanical and electrical connection between the first half 40 and the second half 52.

To better help differentiate the modifications that are later made to alternate embodiments of the bayonet connector 10 and which are described hereinafter, modified versions of a coupling nut and modified versions of a coupling adapter are recited and the changes that are made to each are described in detail. Each modified version of the coupling nut that is later described refers primarily to a modified form of the first half housing 50 which will include as a necessary part thereof in order to provide a functioning half of an electrical connector, and to permit full and proper operation thereof, the inner portion of a modified first half 40. Each modified version of the coupling adapter that is later described refers to a modified form of the second half 52. Each modified version of the coupling adapter cooperates with a respectively modified version of the coupling nut. When used together, each modified version of the coupling nut and each correspondingly modified version of the coupling adapter combine to provide a modified version of the bayonet connector 10 with the specific capabilities and benefits thereof that are later described.

The first half housing 50 surrounds a portion of the sleeve 74 and a portion of the cylindrical portion of rubber 84 that extends beyond the sleeve 74 and in a direction that is generally toward the second half 52.

When the first half 40 of the bayonet connector 10 is initially being mated with the second half 52 of the bayonet connector 10, the portion of the cylindrical portion of rubber 84 that extends beyond the sleeve 74 enters into an exposed and open end of the second half 52 (See top left portion of FIG. 7). When the first half 40 is fully mated to the second half 52, the distal end of the cylindrical portion of rubber 84 that is disposed away from the sleeve 74 is proximate a surface of the rubber seal 64.

When the first half 40 of the bayonet connector 10 is fully mated to the second half 52 of the bayonet connector 10 a primary environmental seal is provided by compression occurring circumferentially at a lip-seal area of the cylindrical portion of rubber 84, as described in greater detail in the following paragraph. In general, the primary environment seal helps to prevent the entry of volatile gases. Compression at the lip-seal area by the primary environment seal also provides an additional important benefit, which is described in greater detail hereinafter.

The primary environmental seal (see FIG. 6) is provided by a cylindrical metal lip sealing member 85 of the second half 52 that circumferentially engages with a rubber molded lip-seal 84*a* portion of the cylindrical portion of rubber 84. During connection, the cylindrical metal lip sealing member 85 enters into a circumferential channel provided by the lip-seal portion 84*a*. As the cylindrical metal lip sealing member 85 is progressively urged further into the circumferential channel, a lower portion of the cylindrical metal lip sealing member 85 is surrounded on an inside and outside circumference by the elastomer of the lip-seal portion 84*a*. As the cylindrical metal lip sealing member 85 is progressively urged further into the circumferential channel, a leading edge of the cylindrical metal lip sealing member 85 makes contact with the elastomer that is disposed at the bottom of the lip-seal portion 84*a*. As final engagement (i.e., coupling of the first half 40 with the second half 52 occurs), the elastomer that is disposed at the bottom of the lip-seal portion 84*a* is compressed by the leading edge of the cylindrical metal lip sealing member 85, thereby providing the primary environmental seal. The primary environmental seal provides a first environmental seal that occurs during mating and which provides a sustained level of environmental sealing that also occurs during separation of the first half 40 from the second half 52 (i.e., during a substantial amount of relative longitudinal motion occurring during an initial phase of separation).

An additional compression of the cylindrical portion of rubber 84 that occurs proximate each of the conical recessed portions 86 by the first portion 68 of the support cone 70 during mating provides a secondary environmental seal to further help prevent the entry of volatile gases. The secondary environment seal is established (formed) after formation of the primary environmental seal has occurred during a final phase of mating. The secondary environment seal is lost or compromised during an initial phase of decoupling and this occurs before a loss of the primary environmental seal has typically occurred.

Together, the primary and secondary environmental seals effectively preclude the entry of any volatile gas that may be disposed in mixture in the ambient atmosphere from entering into the bayonet connector 10 during a critical phase of decoupling. The critical phase of decoupling includes all relative longitudinal motion that occurs between the first half 40 and the second half 52 during decoupling until after all of the electrical contact pins 62 have each been separated from their corresponding electrical sockets 66 and there remains no significant further risk of a spark (whether by static discharge or induction) occurring in the bayonet connector 10.

The wellhead 12, the feed-through 16, the sleeve 74, the elbow housing 78 and other component parts of the oil or gas well (other than that of the bayonet connector 10) are identical with those used with the prior art type of connector (4, 6). What is new with the bayonet connector 10 are the first half housing 50 and the housing of the second half 52.

Figure 5:
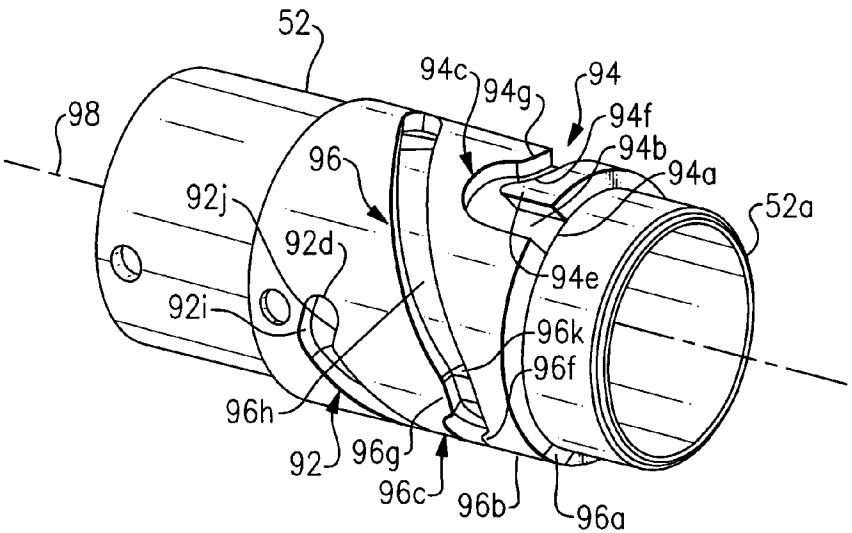
FIG. 5 is a view in perspective of the coupling adapter of FIG. 3 in a second position showing an opposite side thereof.
Figure 4:
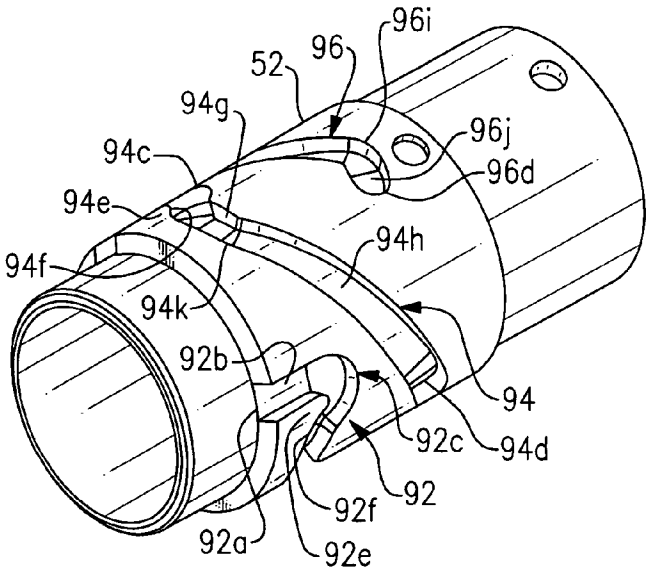
FIG. 4 is a view in perspective of the coupling adapter of FIG. 3 in a first position showing a first side thereof.

This is important to understand because it demonstrates how the remainder of the existing component parts that are also used with the prior art (4, 6) other than the first half housing 50 and the housing portion of the second half 52 are not affected by use of the bayonet connector 10 and, accordingly, may be used with either the prior art or the instant invention. To incorporate the teachings herein, the prior art first half housing 4 is replaced by the first half housing 50 of the bayonet connector 10 and the prior art second half housing 6 is replaced by the housing portion (only) of the second half 52 of the bayonet connector 10. No other changes are required. The housing portion of the second half 52 is that portion as shown in FIG. 4 or FIG. 5. As mentioned previously in a discussion about the prior art, the second half 52 of the bayonet connector 10 can be machined and included as an integral component part of the feed-through, if desired.

A distal end (not shown) of the electrical cable 80 is typically attached to a circuit breaker or other means of disconnecting the electrical power that is supplied to the oil well. Electrical ground is provided the moment the first half housing 50 makes physical contact with the second half 52, both of which are metallic and electrically grounded. An electrical circuit that supplies power to the pump is provided through the electrical cable 80, the elbow housing 78, the first and second halves of the electrical connector, the feed-through 16, and the inner cable 18.

A plurality of bayonet-style inward-protruding pins 88 pass through openings provided through the first half housing 50 and extend a predetermined distance into an interior of the first half housing 50 and generally toward the longitudinal center thereof. According to the preferred embodiment three inward-protruding pins 88 are provided, although a minimum of one can be used for certain applications, if desired. However, two or more of the inward-protruding pins 88 are generally preferred in order to provide smooth operation and optimum performance of the bayonet connector 10.

A skirt 90 portion (FIG. 3) is attached to the first half housing 50 and extends in a direction that is generally away from the elbow housing 78 and toward the second half 52. The skirt 90 is cylindrical and has no openings therein. The skirt 90 includes an inside diameter that is slightly larger than an outside diameter of the second half 52.

This tolerance, which is referred to as a "diametric clearance", is controlled so that the inside diameter of the skirt 90 portion does not exceed the outside diameter of the second half 52 by more than 0.002 inches at any important area along the circumference of the second half 52. Accordingly, the maximum diametric clearance is limited to 0.002 inches. An important first area 91*a* is found between an inside of the first half housing 50 and an outside of the sleeve 74 extending from the retaining ring 76 and toward the second half 52 for a distance that includes at least 6 mm of longitudinal length. An important second area 91*b* is found between an inside of the skirt 90 and an outside of the second half 52 and which extends in a direction that is generally toward the electrical cable 80 for a distance that includes at least 6 mm of longitudinal length.

As is described in greater detail hereinafter, control of the diametric clearance tolerance is used to extinguish the propagation of any flame through the bayonet connector 10, providing that a longitudinal length of at least 6 mm of this tolerance is maintained at the important first and second areas 91*a*, 91*b* during the critical phase of decoupling. This is described in greater detail hereinafter.

Each of the inward-protruding pins 88 enters into and cooperates with a corresponding one of a plurality of outward facing slots, each slot being identified in general by the reference numerals 92, 94, 96. The slots 92, 94, 96 are provided along an exterior of a generally raised portion of the second half 52. The generally raised portion includes an outside diameter that is greater than the outside diameter of any other portion of the second half 52. Each of the slots 92, 94, 96 is disposed in a spaced-apart relationship with respect to a remainder thereof and each of the slots 92, 94, 96 is identical in contour (i.e., in curvature) as compared to the remainder thereof.

Each of the slots 92, 94, 96 includes a depth that is less than the thickness of the material used to form the second half 52. The depth of each of the slots 92, 94, 96 is slightly greater than a longitudinal length of the portion of each of the inward-protruding pins 88 that is disposed inside of the first half housing 50. Accordingly, each of the slots 92, 94, 96 is able to receive the portion of the inward-protruding pins 88 that are disposed inside of the first half housing 50. The width of each of the slots 92, 94, 96 is slightly greater than the outside diameter of the portion of the inward-protruding pins 88 that are disposed inside of the first half housing 50.

Accordingly, the inward-protruding pins 88 are able to be urged in unison along the longitudinal length (i.e., to follow the curvature) of the slots 92, 94, 96 for the entire length of the slots 92, 94, 96. When the inward-protruding pins 88 are urged along the slots, 92, 94, 96 the first half housing 50 is either being mated with (i.e., coupled to) the second half 52 or separated (i.e., decoupled) from the second half 52. Accordingly, the first half 40 is either being mated with (i.e., coupled to) the second half 52 or separated (i.e., decoupled) from the second half 52 of the bayonet connector 10 in response to the motion of the first half housing 50.

To attach or detach the first half housing 50 with respect to the second half 52, the spanner wrench (as was used with the prior art) engages with the recess 9 (one or more) provided in the first half housing 50. Additional recesses 9 are also included in the second half 52 and are used to secure the second half 52 to the feed-through housing 54. Along with an application of manual pressure urging the first half housing 50 at times either longitudinally toward or, at other times, away from the second half 52, the spanner wrench is used to rotate the first half housing 50 about a center longitudinal axis thereof, either in a clockwise or counterclockwise direction.

When the first half housing 50 is rotated the inward-protruding pins 88 follow the contour of the slots 92, 94, 96 which results in a longitudinal displacement of the first half housing 50 with respect to the second half 52, the direction of the displacement (i.e., either inward or outward) depending on the direction of rotation by the first half housing 50. During tightening, the contour of the slots 92, 94, 96 urges each of the inward-protruding pins 88 of the first half housing 50, and therefore the entire first half of the bayonet connector 10, simultaneously toward the second half 52 until the first half housing 50 is fully engaged, both mechanically and electrically, with the second half 52.

During loosening, the contour of the slots 92, 94, 96 urges the inward-protruding pins 88 of the first half housing 50 away from the second half 52 until the first half housing 50 is fully disengaged, both mechanically and electrically, from the second half 52. The first half housing 50 rotates about the sleeve 74 and, therefore, it rotates with respect to the electrical cable 80 that the first half housing 50 is attached to. The first half housing 50 also rotates with respect to the plurality of electrical sockets 66 and the cylindrical portion of rubber 84 that are disposed therein. The electrical sockets 66 do not rotate with respect to the electrical cable 80 when the first half housing 50 is rotated.

To engage the first half housing 50 with the second half 52 of the bayonet connector 10, each of the inward-protruding pins 88 are first aligned with a corresponding respective slot opening 92*a*, 94*a*, 96*a* of each of the slots 92, 94, 96. The first half housing 50 is then urged toward the second half 52 as far as it will go along the longitudinal length of a respective first linear portion 92*b*, 94*b*, 96*b* of each of the slots 92, 94, 96. The first linear portion 92*b*, 94*b*, 96*b* of each of the slots 92, 94, 96 is in parallel alignment with respect to a center longitudinal axis 98 of the second half 52.

The inward-protruding pins 88 travel longitudinally after entering each of the slot openings 92*a*, 94*a*, 96*a* and along each respective first linear portion 92*b*, 94*b*, 96*b* until the inward-protruding pins 88 each simultaneously reach a distal end of each of the first linear portions 92*b*, 94*b*, 96*b* where a first curvature portion, identified in general by the reference numerals 92*c*, 94*c*, 96*c* of each of the slots, is disposed and connected to each of the first linear portions 92*b*, 94*b*, 96*b*.

The user then rotates the first half housing 50 (either by hand or with the use of the spanner wrench) while allowing the first half housing 50 to move tangentially around the second half 52 and also to retract slightly in an upward direction that is generally toward the slot openings 92*a*, 94*a*, 96*a* and generally away from the second half 52. This motion occurs in response to each of the inward-protruding pins 88 that are being urged along a corresponding one of the first curvature portions 92*c*, 94*c*, 96*c*.

In general, during connection or disconnection, the motion of the inward-protruding pins 88 and therefore of the first half housing 50 in relation to the second half 52 will track the variations in contour of each of the slots 92, 94, 96. During connection, a center of each of the inward-protruding pins 88 follows a centerline of each of the slot openings 92*a*, 94*a*, 96*a* in a generally downward direction toward the second half 52. This motion continues until the inward-protruding pins 88 simultaneously reach an opposite fully engaged slot position 92*d*, 94*d*, 96*d* that is provided at a distal end of each of the slots 92, 94, 96.

It is also important to note that the variations in contour of each of the slots 92, 94, 96 are identical because each slot 92, 94, 96 has an identical size and shape as compared to any other slot 92, 94, 96. Each slot 92, 94, 96 is offset in position along the circumference of the second housing 52 with respect to any other remaining slot 92, 94, 96. Similarly, each of the inward-protruding pins 88 is offset in position on the first half housing 52 so as to correspond with, and therefore align with, the slot 92, 94, 96 locations.

Therefore, during use as well as during connection or disconnection, each of the inward-protruding pins 88 will always be disposed at an identical position in each of the slots 92, 94, 96 as compared to any of the other inward-protruding pins 88 in any of the remaining slots 92, 94, 96.

A protruding lip 92*e*, 94*e*, 96*e* extends down toward each of the first curvature portions 92*c*, 94*c*, 96*c*. The protruding lip 92*e*, 94*e*, 96*e* includes an edge surface 92*f*, 94*f*, 96*f* that is disposed on a side of the protruding lip 92*e*, 94*e*, 96*e* that is distally located with respect to the first linear portion 92*b*, 94*b*, 96*b*. The edge surface 92*f*, 94*f*, 96*f* provides an abrupt edge that prevents inadvertent separation from occurring of the first half housing 50 with respect to the second half 52. This is described in greater detail hereinafter.

Continuing in an inward direction along each of the slots 92, 94, 96 a short second linear portion 92*g*, 94*g*, 96*g* continues from a distal end of each of the first curvature portions 92*c*, 94*c*, 96*c*. The second linear portion 92*g*, 94*g*, 96*g* is generally parallel with respect to an end plane 52*a* of the second half 52. Each second linear portion 92*g*, 94*g*, 96*g* extends for a short distance tangentially around the circumference of the second half 52.

A third curvature portion 92*k*, 94*k*, 96*k* connects an end of each of the second linear portions 92*g*, 94*g*, 96*g* that is distally disposed from the edge surface 92*f*, 94*f*, 96*f* to an upper end of a third linear portion 92*h*, 94*h*, 96*h*. Each of the third linear portions 92*h*, 94*h*, 96*h* extend tangentially around the circumference of the second half 52 and also simultaneously along a longitudinal length of the second half 52.

Continuing from the upper end of the third linear portion 92*h*, 94*h*, 96*h* in an inward direction along each of the slots 92, 94, 96, the third linear portions 92*h*, 94*h*, 96*h* will urge the inward-protruding pins 88 toward the second half 52 while at the same time urging the inward-protruding pins 88 around a portion of the circumference of the second half 52.

By this direction of motion the first half housing 50 is being continually urged closer toward the second half 52. A distal lower end of each of the third linear portions 92*h*, 94*h*, 96*h* connects respectively with a fourth curvature portion 92*i*, 94*i*, 96*i*. Each of the fourth curvature portions 92*i*, 94*i*, 96*i* includes a bottom which is the portion of each slot 92, 94, 96 that is disposed maximally away from the slot openings 92*a*, 94*a*, 96*a*.

When the inward-protruding pins 88 are disposed at the bottom of each of the fourth curvature portions 92*i*, 94*i*, 96*i*, the first half housing 50 will be disposed maximally toward the second half 52. In this position, the leading edge of the cylindrical metal lip sealing member 85 is maximally compressing the elastomer that is disposed at the bottom of the lip-seal portion 84*a* (See FIG. 6). At the same time, the first portion 68 of each of the support cones 70 is also maximally compressing the conical recessed portions 86.

As a result of the compression of the above-described elastomers (86, 84*a*), a separating force is created that is attempting to urge the first half housing 50 in a direction that is generally away from the second half 52. During connection, the magnitude of the separating force is being overcome by the operator who is using a spanner wrench and applying sufficient force to the spanner wrench to tighten the first half housing 50.

As the operator is tightening the first half housing 50, the inward-protruding pins 88 of the first half housing 50 are being urged until reaching a lower portion of each of the third linear portions 92*h*, 94*h*, 96*h* of the slots 92, 94, 96. The operator continues to tighten the first half housing 50 until each of the inward-protruding pins 88 has reached the bottom of each of the fourth curvature portions 92*i*, 94*i*, 96*i*.

As the inward-protruding pins 88 are progressively being urged along the slots 92, 94, 96 by action of the operator, they supply a connecting force to the first half housing 52 that is greater than the separating force. The connecting force is in an opposite direction as compared to the separating force. The operator increases the force that is being applied to the spanner wrench as required in order to continue to rotate the first half housing 50 and, thereby, urge the inward-protruding pins 88 further toward the second half 50 until they each reach the bottom of the fourth curvature portions 92*i*, 94*i*, 96*i*.

Continuing in an inward direction along each of the slots 92, 94, 96 each of the fourth curvature portions 92*i*, 94*i*, 96*i* connects respectively to a first end of a short fourth linear portion 92*j*, 94*j*, 96*j*. An opposite end of each of the fourth linear portion 92*j*, 94*j*, 96*j* terminates at a corresponding one of the fully engaged slot positions 92*d*, 94*d*, 96*d*. The fully engaged slot positions 92*d*, 94*d*, 96*d* of each of the slots 92, 94, 96 are where each of the slots 92, 94, 96 ends (terminates) at an end of each of the slots 92, 94, 96 that is disposed maximally away from the slot openings 92*a*, 94*a*, 96*a*.

Continued tightening of the first half housing 50 urges each of the inward-protruding pins 88 from the fourth curvature portions 92*i*, 94*i*, 96*i* and into the fourth linear portions 92*j*, 94*j*, 96*j*. The fourth linear portions 92*j*, 94*j*, 96*j* (continuing in the same direction) include a slope that is generally opposite that of the third linear portions 92*h*, 94*h*, 96*h*. Accordingly, continued tightening of the first half housing 50 will cause the inward-protruding pins 88 to follow the centerline of the fourth linear portion 92*j*, 94*j*, 96*j* and to be displace slightly further away from the second half 50 than when the inward-protruding pins 88 were disposed at the bottom of the fourth curvature portions 92*i*, 94*i*, 96*i*.

The separating force also urges the inward-protruding pins 88 along the fourth linear portion 92*j*, 94*j*, 96*j* until they reach the fully engaged slot positions 92*d*, 94*d*, 96*d* and come to an abrupt stop.

This provides both an audible and tactile indication (i.e., feedback) to the operator that the first half housing 50 is fully engaged with the second half 52. The operator hears a "snap" when the inward-protruding pins 88 make contact with the fully engaged slot positions 92*d*, 94*d*, 96*d*. The operator also feels a sudden release in the tightening force that is required as soon as the inward-protruding pins 88 each enter into the fourth linear portions 92*j*, 94*j*, 96*j*.

Accordingly, the operator does not have to visually verify that proper attachment has occurred. This saves time and prevents improper attachment of the first half housing 50 with respect to the second half 52 from occurring.

Additionally, a first means of securing the first half housing 50 to the second half 52 in the fully secured position is provided that prevents a first inadvertent separation thereof from occurring. In this manner, a mechanical latch is provided that ensures that both mechanical and electrical connection will be maintained until separation is desired.

In order to remove the first half housing 50 from the second half 52, the operator must reverse the position of the spanner wrench and supply a force to the spanner wrench that urges the first half housing 50 in an opposite direction as compared to the direction it was urged when tightening. Considerable (relative) force must be initially applied to the first half housing 50 to urge the inward-protruding pins 88 along the fourth linear portion 92*j*, 94*j*, 96*j* and closer toward the second half 52 because the elastomers (86, 84*a*), as previously mentioned, must again be further compressed.

During loosening when each of the inward-protruding pins 88 again reach the bottom of the fourth curvature portion 92*i*, 94*i*, 96*i* the separating force is then able to urge the inward-protruding pins 88 of the first half housing 50 upward for a short distance along the lower portion of the third linear portions 92*h*, 94*h*, 96*h* and away from the second half 50. After a short distance of travel by the inward-protruding pins 88 in the third linear portions 92*h*, 94*h*, 96*h* the separating force stops when compression of the elastomers (64, 84) is no longer occurring.

From this point it is easy to continue to separate the first half housing 50 from the second half 52 by continued rotation of the first half housing 50 in the direction that is opposite the direction it was rotated during tightening. The inward-protruding pins 88 will travel along the length of the third linear portions 92*h*, 94*h*, 96*h* and generally away from the second half 52 during separation.

It is important to note that each of the electrical contact pins 62 must separate electrically from each corresponding one of the electrical sockets 66 while the inward-protruding pins 88 are disposed in a disconnect portion of the third linear portions 92*h*, 94*h*, 96*h*. The disconnect portion begins a predetermined distance above the fourth curvature portion 92*i*, 94*i*, 96*i* and ends prior to reaching a plane that corresponds with the lowest portion of the first curvature portions 92*c*, 94*c*, 96*c* (i.e., a bottom of the first curvature portions 92*c*, 94*c*, 96*c* that is disposed maximally away from the slot openings 92*a*, 94*a*, 96*a*).

Electrical disconnection occurring while the inward-protruding pins 88 are disposed in the disconnect portion of the third linear portions 92*h*, 94*h*, 96*h* ensures that electrical disconnection of the bayonet connector 10 will occur before the inward-protruding pins 88 are disposed as far from the bottom of the fourth curvature portions 92*i*, 94*i*, 96*i* as the bottom of the first curvature portions 92*c*, 94*c*, 96*c* is disposed from the bottom of the fourth curvature portions 92*i*, 94*i*, 96*i*.

Electrical disconnection occurring while the inward-protruding pins 88 are disposed in the disconnect portion of the third linear portions 92*h*, 94*h*, 96*h* also ensures that electrical disconnection of the bayonet connector 10 will occur before the inward-protruding pins 88 reach the edge surface 92*f*, 94*f*, 96*f*. The importance of this is discussed below.

Electrical disconnection occurring while the inward-protruding pins 88 are disposed in the disconnect portion of the third linear portions 92*h*, 94*h*, 96*h* also further ensures that electrical connection between any of the electrical contact pins 62 and the electrical sockets 66 will not recur during a remainder of the disconnection procedure as the inward-protruding pins 88 are urged in sequence along the second linear portion 92*g*, 94*g*, 96*g*, then downward past the edge surface 92*f*, 94*f*, 96*f*, around the first curvature portion 92*c*, 94*c*, 96*c*, upward along the first linear portion 92*b*, 94*b*, 96*b*, and eventually out of the slot openings 92*a*, 94*a*, 96*a*, thereby completing disconnection of the first half housing 50 from the second half 52.

It is also important to note that flame path requirements are still maintained while the inward-protruding pins 88 are disposed in the fourth curvature portions 92*i*, 94*i*, 96*i* and in the fourth linear portion 92*j*, 94*j*, 96*j* as well as for at least a portion of the third linear portions 92*h*, 94*h*, 96*h*. Alternately, the bayonet connector 10 can be modified by extension of the teachings herein to maintain flame path requirements while the inward-protruding pins 88 are disposed in any desired portion along the length of the slots 92, 94, 96 in order to maintain compliance with any desired standard of certification.

If electrical power was not disconnected from the electrical cable 80 before disconnecting the bayonet connector 10 at the wellhead 12, ignition and subsequent combustion (or explosion) of any volatile gases that may be disposed inside of the bayonet connector 10 is possible. During mechanical separation for the first half housing 50 from the second half 52, which also results in the electrical disconnection of the electrical contact pins 62 from the electrical sockets 66, a spark can occur if electrical power to the electrical cable 80 has not been disconnected, as is procedurally required. The spark can ignite any volatile gases that may be present.

If this were to occur, the first half housing 50 and the first half 40 would be rapidly urged away from the wellhead 12 and away from the second half 52, thereby posing a hazard to the operator were it not for the benefit provided by the edge surface 92*f*, 94*f*, 96*f*, the protruding lip 92*e*, 94*e*, 96*e*, and by the first curvature portion 92*c*, 94*c*, 96*c*. When these structures are included in their respective positions, as shown, they combine to provide an important resultant safety benefit, as is further described below.

If the first half housing 50 is urged by such combustion (or explosion) in a direction that is generally away from the second half 52 disposed at the wellhead 12, the inward-protruding pins 88 will be urged along the upper portion of the third linear portions 92*h*, 94*h*, 96*h* and along the second linear portions 92*g*, 94*g*, 96*g* until the inward-protruding pins 88 contact the edge surface 92*f*, 94*f*, 96*f* of the protruding lips 92*e*, 94*e*, 96*e* which stops rotation of the first half housing 50 from continuing around the center longitudinal axis 98 of the second half 52. The required 6 mm of 0.002 inch tolerance is maintained where desired throughout this range of motion which ensures that a flame path cannot occur through the bayonet connector 10 and possibly ignite volatile ambient gases.

Additionally, for continued rotation of the first half housing 50 to occur in a direction that is necessary to separate the first half housing 50 apart from the second half 52, the inward-protruding pins 88 would have to be urged in a direction that urges them closer toward the second half 52 by an amount that is sufficient to permit the inward-protruding pins 88 to pass below the edge surface 92*f*, 94*f*, 96*f* and along the first curvature portion 92*c*, 94*c*, 96*c*. The force of combustion, however, is supplying a second separating force that continues to urge the first half housing 50 away from the second half housing 52 for as long as combustion is occurring.

Accordingly, the unique curvature of the slots 92, 94, 96, as are provided by the edge surfaces 92*f*, 94*f*, 96*f* in combination with the protruding lips 92*e*, 94*e*, 96*e* and the first curvature portions 92*c*, 94*c*, 96*c*, provide a second means of securing the first half housing 50 in cooperation with the second half 52 that prevents a second inadvertent separation thereof from occurring.

In summary, the third linear portions 92*h*, 94*h*, 96*h* provide an intermediate portion of each slot 92, 94, 96. The portion of each of the third linear portions 92*h*, 94*h*, 96*h* that is disposed closest to the distal inside screw threads 9*a* is a bottom portion of each of the intermediate portions and is where electrical conductivity is maintained between the electrical contact pins 62 and the electrical sockets 66.

The portion of each of the third linear portions 92*h*, 94*h*, 96*h* that is disposed furthest away from the distal inside screw threads 9*a* is an upper portion of each of the intermediate portions and is where electrical conductivity is severed between all of the electrical contact pins 62 and the electrical sockets 66.

Referring momentarily to FIG. 3, the skirt 90 of the first half housing 50 extends sufficiently far over and around the second half 52 to ensure that at least 6 mm of linear overlap (i.e., in a direction which is parallel with the center longitudinal axis 98 of the second half 52) by the skirt 90 will occur around the outside circumference of the second half 52. Additionally, a minimum of 6 mm of overlap must extend downward from the bottom of the fourth curvature portions 92*i*, 94*i*, 96*i* and to an end 100*a* of a raised portion 100 of the second half 52 when the inward-protruding pins 88 are each disposed in the disconnect portion of the third linear portions 92*h*, 94*h*, 96*h* until disconnection of all of the electrical contact pins 62 from the electrical sockets 66 has also occurred.

Additionally, a maximum tolerance of 0.002 inches between the inside of the skirt 90 of the first half housing 50 and the outside of the raised portion 100 of the second half 52 must also be maintained until disconnection of all of the electrical contact pins 62 from the electrical sockets 66 has occurred. Ideally, the length of the skirt 90 is sufficiently extended while not exceeding the maximum tolerance of 0.002 inches between the inside of the skirt 90 of the first half housing 50 until, during separation, to provide flame path protection until the inward-protruding pins 88 have reached the second linear portions 92*g*, 94*g*, 96*g*.

In this way, in the event of ignition of volatile gases inside the bayonet connector 10, the propagation of a flame along a flame path inside the bayonet connector 10, such as could be provided by the slots 92, 94, 96 is extinguished by the maximum tolerance of 0.002 inches or less that exists between the skirt 90 and the raised portion 100 of the second half 52, and which extends for at least the minimal linear length of 6 mm below the slots 92, 94, 96.

In order to maintain compliance with certain standards, it is necessary to maintain flame path protection during the disconnection process until after a predetermined minimum amount of separation (i.e., a predetermined minimum gap) has occurred between the electrical contact pins 62 and the electrical sockets 66 beginning measurement of the predetermined minimum amount of separation after electrical conductivity has been severed between all of the electrical contact pins 62 and all of the electrical sockets 66. This is to ensure that there is no possibility that an inductive arc might still occur between any of the electrical contact pins 62 and the electrical sockets 66 at any location where flame path protection is not also provided.

By control of the tolerances and the length of the skirt 90 it is possible to modify the bayonet connector 10 in order to maintain flame path protection during as much or during as little of the disconnection process, as desired. For some applications or standards during the disconnection process it may be desirable to maintain flame path protection only until the inward-protruding pins 88 have reached the second linear portions 92*g*, 94*g*, 96*g* while for a considerably more severe application or standard it may be desirable to maintain flame path protection until after the inward-protruding pins 88 have separated completely from any engagement with the slots 92, 94, 96. Also, the bayonet connector 10 can be additionally modified, as desired, for use in safer environments or for use in different applications or to comply with other standards that do not require flame path protection. It is useful to note that during coupling or decoupling the diametric clearance at the important first area 91*a* does not vary.

Accordingly, the resultant bayonet connector 10 provides quick, safe, easy attachment along with a tactile and audible confirmation of proper attachment and quick, safe, and easy detachment while conforming to the desired industry standards. Additionally, less than one revolution of the first half housing 50 (i.e., of a first half of the connector) with respect to the second half 52 (i.e., of a second half of the connector) is required in order to connect or disconnect the first half 40 apart from the second half 52.

After having had benefit of the above disclosure, other changes will now become apparent to those having ordinary skill in the art. For example, it may be possible by modification to reverse the first half 40 and second half 52, as desired, whereby the first half housing 50 can be attached to the wellhead 12 and the second half 52 attached to the electrical cable 80. Similarly, it is possible to reverse the electrical contact pins 62 and the electrical sockets 66 so that either are disposed in either the first half housing 50 or in the second half 52.

Similarly, variations in the number or in the size of the inward-protruding pins 88 and the slots 92, 94, 96, the profile of the inward-protruding pins 88, or any variation or addition that is made to the path of the slots 92, 94, 96 and which does not depart from the scope and spirit of the invention, are also possible.

If desired, one or more set screws (not shown) can engage with set screw threads that are provided in the first half housing 50. The set screw can be tightened to bear on the second half 52 to further ensure that the two connector halves will remain secured together after coupling.

Also some applications of the bayonet connector 10 will include underwater (or other fluid) submersion. Additional seals (not shown) can be provided where desired to permit submerged usage and to maintain any desired degree of environmental sealing, as is desired.

Figure 8:
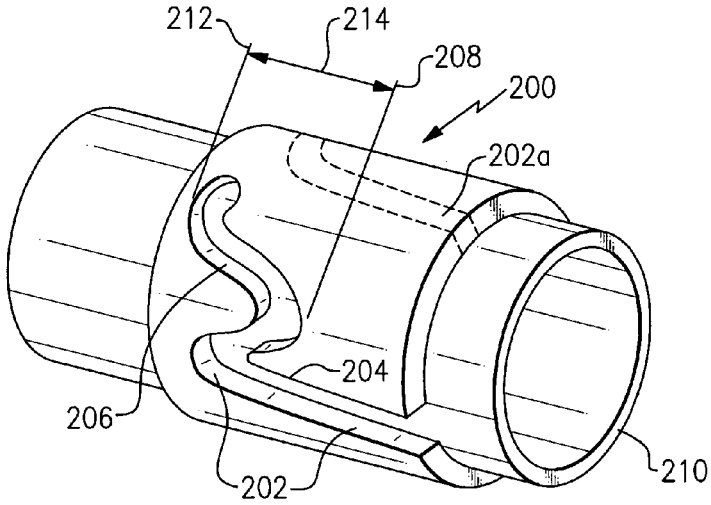
FIG. 8 is view in perspective of a first modified coupling adapter of the bayonet connector of FIG. 1.

Referring now to FIG. 8 is shown a first modified coupling adapter, identified in general by the reference numeral 200, of the bayonet connector 10 of FIG. 1. The first modified coupling adapter 200 is a first modified version of the second half 52 of the bayonet connector 10.

The first modified coupling adapter 200 includes a first modified slot 202. As desired, one or more identically contoured additional first modified slots (202*a* shown in dashed lines) are included. For most applications, it is anticipated that two or more of the first modified slots 202 will be included to provide a more stable secure and balanced mounting.

The first modified slot 202 includes substantially the same contour variations as does the second half 52, however, the first modified slot 202 includes an elongated first linear portion 204. The elongated first linear portion 204 is a substantially longer version of the first linear portions 92*b*, 94*b*, 96*b* of the second half 52.

Additionally, the first modified slot 202 includes an abbreviated third linear portion 206. The abbreviated third linear portion 206 is a substantially shorter version of the third linear portions 92*h*, 94*h*, 96*h* of the second half 52.

The length and placement of the equivalent electrical contact pins 62 and their equivalent corresponding electrical sockets 66 in the first modified coupling adapter 200 and in a corresponding first modified coupling nut (not shown) for use with the first modified coupling adapter 200 are varied to ensure that electrical conductivity between all of the electrical contact pins 62 and all of the electrical sockets 66 of a desired group is severed at some point while the inward protruding pin(s) 88 of the first modified coupling nut are disposed along an upper portion of the longitudinal length of the elongated first linear portion 204 when the corresponding first modified coupling nut is urged longitudinally away from the first modified coupling adapter 200.

It is important to note that with the first modified coupling adapter 200 electrical conductivity between the desired group of the electrical contact pins 62 and the electrical sockets 66 is maintained whenever the inward protruding pin(s) 88 of the first modified coupling nut are disposed below (i.e., to the left, as shown in FIG. 8) of an upper reference line 208. Stated another way, whenever the inward-protruding pin(s) of the first modified coupling nut are disposed on a distal side of the upper reference line 208 (i.e., to the left of the upper reference line 208) with respect to an end plane 210 of the first modified coupling adapter 200, electrical conductivity is maintained between the desired group of the electrical contact pins 62 and the electrical sockets 66 of the first modified coupling adapter 200 and the first modified coupling nut.

A lower reference line 212 is shown to indicate the maximum amount that the inward-protruding pins 88 of the first modified coupling nut can be disposed away from the end plane 210 of the first modified coupling adapter 200. Arrow 214, which is the longitudinal distance between the lower reference line 212 and the upper reference line 208, indicates an area of displacement of the first modified coupling nut with respect to the first modified coupling adapter 200 where the desired group of the electrical contact pins 62 and the corresponding electrical sockets 66 are designed to be electrically connected together.

When the inward-protruding pin(s) 88 of the first modified coupling nut are disposed along an upper portion of the elongated first linear portion 204 on a proximate side of the upper reference line 208 (i.e., to the right of the upper reference line 208) and when the first modified coupling nut is being urged away (i.e., disconnected) from the first modified coupling adapter 200, electrical conductivity is severed between the desired group of the electrical contact pins 62 and the electrical sockets 66 of the first modified coupling adapter 200 and the first modified coupling nut.

This arrangement provides many unexpected benefits that are discussed in greater detail hereinafter.

If preferred, the desired group can include all of the electrical contact pins 62 and all of the electrical sockets 66 of the first modified coupling adapter 200 and the first modified coupling nut but, preferably, a status electrical socket of the electrical sockets 66 and a corresponding status electrical contact pin of the electrical contact pins 62 are also included and are not part of the desired group. The status electrical contact pin mates with the status electrical socket.

The length of the status electrical pin and the status electrical socket are modified (i.e., one or both are shortened longitudinally) with respect to the longitudinal lengths of the remaining electrical contact pins 62 and the remaining electrical sockets 66 of the desired group (of the first modified coupling adapter 200 and the first modified coupling nut). This is to ensure that the electrical connection between the status electrical contact pin and the status electrical socket is severed before the electrical connection between any of the remaining electrical contact pins 62 and any of the remaining electrical sockets 66 of the desired group are severed.

The status electrical socket and the status electrical contact pin, together, provide a useful indication of the mechanical connection between the first modified coupling nut and the first modified coupling adapter 200. This also provides an important unexpected benefit that is discussed in greater detail hereinafter.

The electrical connection between the status electrical contact pin and the status electrical socket is preferably designed to be severed (i.e., to be broken) as soon as the first modified coupling nut is loosened from its fully engaged position with the first modified coupling adapter 200 and the first modified coupling adapter 200 is urged (by elastomeric or spring compression or any other desired means) in the abbreviated third linear portion 206 and sufficient far away from the bottom of the fourth curvature portion 92*i* (and, if included, 94*i*, 96*i*).

As soon as the first modified coupling nut is loosened from a fully engaged or latched position (i.e., when the inward-protruding pin(s) 88 of the first modified coupling nut are displaced on the abbreviated third linear portion 206 side with respect to the bottom of the fourth curvature portion 92*i* (and, if included, 94*i*, 96*i*) of the first modified coupling adapter 200), the inward-protruding pin(s) 88 of the first modified coupling nut will be disposed in the abbreviated third linear portion 206 and urged in a direction that is generally toward the end plane 210.

The length and position of the status electrical contact pin and the status electrical socket are varied so that, as soon as possible after the inward-protruding pin(s) 88 of the first modified coupling nut are disposed in the abbreviated third linear portion 206 and at a further longitudinal distance away from the lower reference line 212 than they are disposed away from the lower reference line 212 when the inward-protruding pin(s) 88 of the first modified coupling nut are disposed at the fully engaged slot position 92*d* (and, if included, 94*d*, 96*d*), the electrical connection between the status electrical contact pin and the status electrical socket is designed to be severed.

If, for example, the first modified coupling nut were somehow inadvertently loosened from its fully engaged position (i.e., when the inward-protruding pin(s) 88 of the first modified coupling nut are displaced on the abbreviated third linear portion 206 side with respect to the bottom of the fourth curvature portion 92*i*), it is expected that the inward-protruding pin(s) 88 of the first modified coupling nut would be displaced in the abbreviated third linear portion 206 and further away from the lower reference line 212 than when they were disposed at the fully engaged slot position 92*d*.

This would result in a severing of the electrical connection between the status electrical contact pin and the status electrical socket while preserving the electrical connection between all of the remaining electrical contact pins 62 and the remaining electrical sockets 66 of the desired group of the first modified coupling adapter 200 and the first modified coupling nut.

The severing of the electrical connection between the status electrical contact pin and the status electrical socket is detected and is used to alert an operator that the connection has loosened, for example, by providing a visual or audio indication to the operator who can take corrective action at the first possible or safe opportunity. If desired, a light on a console can be illuminated or the disconnection can be sensed by a computer.

However, because all of the remaining electrical contact pins 62 and all of the remaining electrical sockets 66 of the desired group have maintained their electrical connectivity, critical system operational and control functions are still maintained.

Therefore, the first modified coupling adapter 200 and the first modified coupling nut provide fail-safe system operation even in the event of an inadvertent partial decoupling of the first modified coupling nut from the first modified adapter 200 and, when the status electrical contact pin and the status electrical socket are included, added security is provided for especially critical applications by alerting the operator of the improper mechanical connection between the first modified coupling nut and the first modified coupling adapter 200 so that corrective action can be taken.

An inadvertent partial decoupling of the first modified coupling nut from the first modified adapter 200 can be caused by an object falling and striking one side of the first modified coupling nut sufficient to rotate it out of its fully engaged position with the first modified coupling adapter 200. An inadvertent partial decoupling can also be caused by inadvertent contact or by excessive vibration especially if, during attachment, the first modified coupling nut was not fully engaged with the first modified coupling adapter 200.

To sever the electrical connection between all of the remaining electrical contact pins 62 and all of the remaining electrical sockets 66 of the desired group, an intentional additional manual input by the operator is required during which the operator must urge the first modified coupling nut closer toward the first modified coupling adapter 200 by an amount sufficient to displace the inward-protruding pin(s) 88 of the first modified coupling nut beyond the lowest portion of the first curvature portion 92*c* (94*c*, 96*c*) of the first modified coupling adapter 200 and into the upper portion (i.e., beyond or to the right of the upper reference line 208) of the elongated first linear portion 204.

Another unexpected benefit is provided when, for whatever reasons, the operator is temporarily unable to correct the situation when an inadvertent partial separation has been detected. For a period of time the operator may be aware of the partial separation while still having to rely on proper system functioning. An example of such a situation can be found in an airplane or a moving vehicle where a pilot, driver, or other type of operator would be temporarily unable to reestablish the desired mechanical connection if an unintentional separation were to occur until the airplane or vehicle is brought to a stop or into a safer condition to effect the reconnection.

In this way, the first modified slot 202 provides a bayonet connector that is suitable for use in especially critical or demanding situations where maintaining electrical connectivity (i.e., proper functioning) is desired. It is anticipated that the first modified coupling adapter 200 and the first modified coupling nut (or any other embodiment of the instant invention) will find applications in aerospace (i.e., in aircraft for civilian use, military purposes, or for use in space-based applications), automotive, boating, military applications, as well as for general use whenever a more secure electrical connection is desired. When a deliberate disconnection is intended, this is easily and quickly accomplished.

Figure 9:
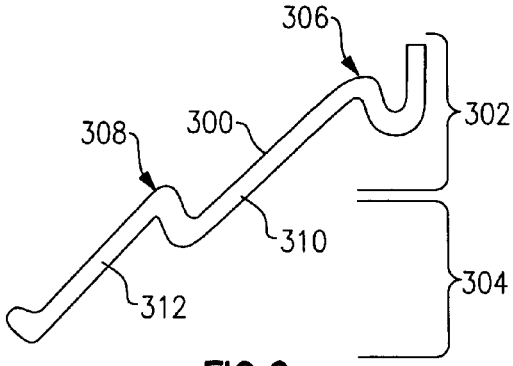
FIG. 9 is plan view showing a modified slot contour of a second modified coupling adapter of the bayonet connector of FIG. 1.

Referring now to FIG. 9 is shown a second modified slot 300 in plan (flat) view, for clarity. In use, the second modified slot 300 would extend radially around a second modified coupling adapter (not shown). One or, preferably, two or more of the second modified slots 300 (all having an identical contour) would be included disposed around the second modified coupling adapter.

The second modified slot 300 includes an upper portion, identified by bracket 302, that is substantially identical to that (i.e., to the contour of a corresponding upper portion of the slots 92, 94, 96) of the second half 52 and it also includes a lower portion, identified by bracket 304, which is substantially identical to the contour of a corresponding lower portion of the first modified slot 202 (or slots) of the first modified coupling adapter 200. The upper portion 302 includes an upper retentive curved portion, identified in general by the reference numeral 306. The lower portion 304 includes a lower retentive curved portion, identified in general by the reference numeral 308.

The upper retentive curved portion 306 prevents unwanted separation from occurring at a time when the inward-protruding pin(s) 88 are disposed in a further modified third linear portion 310, which is generally a shorter in length functional equivalent of the third linear portions 92*h*, 94*h*, 96*h* of the slots 92, 94, 96 and which is generally a longer in length functional equivalent of the abbreviated third linear portion 206 of the first modified slot 202. During separation of a corresponding second modified coupling nut (not shown) from the second modified coupling adapter, and when the inward-protruding pin(s) 88 of the second modified coupling nut are disposed in the further modified third linear portion 310, electrical conductivity is severed between all of the remaining electrical contact pins 62 and the electrical sockets 66 of the desired group (please refer to prior discussion of the first modified coupling adapter 200 for an explanation of the desired group) before the inward-protruding pin(s) 88 have reached an upper portion of the further modified third linear portion 310.

After the inward-protruding pin(s) 88 have reached the uppermost portion of the further modified third linear portion 310, a final release of the second modified coupling nut (and of a corresponding electrical cable that would typically be attached thereto) from the second modified coupling adapter is accomplished by an operator continuing to rotate the second modified coupling nut as required by the contour of the second modified slot 300 while, for a time, pushing the second modified coupling nut inward while continuing to rotate it and then completing the separation process by urging the second modified coupling nut in a final upward direction.

This prevents an inadvertent final separation from occurring because it requires the operator to manipulate the second modified coupling nut by performing a deliberate and specific pattern of movements to the second modified coupling nut relative to the second modified coupling adapter in order to cause a final release, thereof. In this way the operator is able to determine, and thereby control, when the final release is desired and also when it is safe to occur.

The final release process, as previously described, applies generally to every embodiment or possible version of the instant invention (50 and 52, 200, 300). Therefore, the above-described benefits are consistently provided.

The lower retentive curved portion 308 prevents an unwanted separation and a loss of electrical conductivity from occurring (between all desired electrical contact pins 62 and their corresponding electrical sockets 66 of the desired group) at a time when the inward-protruding pin(s) 88 are disposed in a second, lower additional third linear portion 312 (the functional equivalent of the abbreviated third linear portion 206). When the inward-protruding pin(s) 88 of the second modified coupling nut are disposed in the additional third linear portion 312 of the second modified coupling adapter, electrical conductivity is maintained between all of the electrical contact pins 62 and the electrical sockets 66 of the desired group.

A deliberate first disconnect action by the operator is required in order to cause a loss of electrical conductivity between all desired electrical contact pins 62 and their corresponding electrical sockets 66 of the desired group.

After the inward-protruding pin(s) 88 have reached an uppermost portion of the additional third linear portion 312, the first disconnect action is accomplished by the operator rotating the second modified coupling nut as required by the contour of the second modified slot 300 while, for an initial period of time, pushing the second modified coupling nut inward toward the coupling adapter, and while continuing to rotate the second modified coupling nut until the inward-protruding pin(s) 88 have entered into the further modified third linear portion 310.

A continued rotation and urging of the second modified coupling nut away from the second modified coupling adapter, while the inward-protruding pin(s) 88 are being urged generally upward in the further modified third linear portion 310 will result, as previously described, in a severing of electrical conductivity between all of the electrical contact pins 62 and their corresponding electrical sockets 66 of the desired group. Therefore, by the time the inward-protruding pin(s) 88 have reached the uppermost portion of the further modified third linear portion 310, electrical connectivity between all of the electrical contact pins 62 and their corresponding electrical sockets 66 of the desired group and also between the status electrical contact pin and the status electrical socket, if included, will have been severed.

If the status electrical contact pin and the status electrical socket are included in the second modified coupling nut away and the second modified coupling adapter, electrical connectivity there-between will, of course, be severed while the inward-protruding pin(s) 88 are urged upward, along the additional third linear portion 312 and before the inward-protruding pin(s) 88 reach the uppermost portion of the additional third linear portion 312. This would occur in a manner similar to that as was described for the abbreviated third linear portion 206 of the first modified coupling adapter 200.

In this way, detection and indication of a partial decoupling of the second modified coupling nut from the second modified coupling adapter is provided, similar to that as described for the first modified coupling adapter 200. It is, of course, to be understood that if the status electrical contact pin and the status electrical socket are included as part of the second modified coupling nut and the second modified coupling adapter and are monitored for the purpose of providing such an indication, that the indication is intended to be provided to the operator whenever an inadvertent or unintentionally partial separation occurs.

If desired, the indication of a partial decoupling may also be provided during a deliberate decoupling (separation) effort. For especially critical applications, this provides an ability to observe and monitor this initial or first stage of the deliberate decoupling effort of the second modified coupling nut from the second modified coupling adapter.

If desired, an additional monitoring pin and a corresponding additional monitoring socket are included as a contact pair of the desired group of the electrical contact pins 62 and the electrical sockets 66 and are used to generate a second indication when a loss of electrical connectivity between the remaining contact pairs in the desired group has occurred. The additional monitoring pin and the additional monitoring socket may be designed to sever their contact and thereby provide the second indication while electrical connectivity between the remaining contact pairs in the desired group is being severed. This is accomplished by design of the additional monitoring pin and the additional monitoring socket so that they are substantially identical with respect to the remaining electrical contact pins 62 and the electrical sockets 66 of the desired group.

Alternately, if preferred, the design of the additional monitoring pin and the additional monitoring socket are modified so that at least one is somewhat longer or is offset with respect to the remaining electrical contact pins 62 and the electrical sockets 66 of the desired group. This is accomplished, if desired, so that generation of the second indication is delayed slightly until just after electrical connectivity between all of the remaining contact pairs in the desired group has been severed.

This provides an ability to observe and monitor this next or second stage of the deliberate decoupling effort of the second modified coupling nut from the second modified coupling adapter or to monitor any further, and highly unlikely, continuation of an unintentional decoupling process.

If, for any reason it were desired, additional remaining pairs of monitoring pins and corresponding monitoring sockets can be included and designed to sever their respective electrical connections during the decoupling process in order to provide a subsequent third indication and, if desired, subsequent additional indications that provide further information concerning respective additional subsequent stages that occur during the decoupling process. Of course, such a level of monitoring would not normally be required except for the most critical of situations.

In this way any of the benefits and advantages provided by the originally-described bayonet connector 10 and the first modified coupling adapter 200 and the first modified coupling nut can be combined, as desired, into one device (i.e., the second modified coupling adapter and the second modified coupling nut). This further illustrates part of the possible array of benefits that are provided by the bayonet connector 10 and possible modifications, thereof.

Additional changes and modifications are also possible. For example, the colored marking or dot as previously mentioned during a discussion of the prior art can, if desired, also be included as an additional visible indication to further help confirm that a proper connection of the corresponding halves of any version of the bayonet connector 10 has been properly accomplished. In addition to the audible and tactile feedback, the colored marking can provide a fail-safe second indication of proper mounting (i.e., attachment).

It is also important to note that over-engaging (i.e., excessive tightening) of any version of the bayonet connector 10 is not possible due to a limitation in relative motion between the corresponding halves as determined by the overall slot length. Therefore, if the colored marking of the "coupling adapter", for example, is covered by the "coupling nut" a further unexpected benefit is provided in that an operator is able to confirm that a sufficient and proper degree of engagement has occurred without concern of any possible over-engagement.

Also, after having had benefit from the teachings herein, numerous additional modifications to the teachings herein become possible. Various aspects of the teachings herein can be selected (i.e., cherry-picked) to provide additional versions of the bayonet connector 10, not specifically disclosed herein, that may include any of the disclosed features or additional features in any preferred combination.

Figure 10:
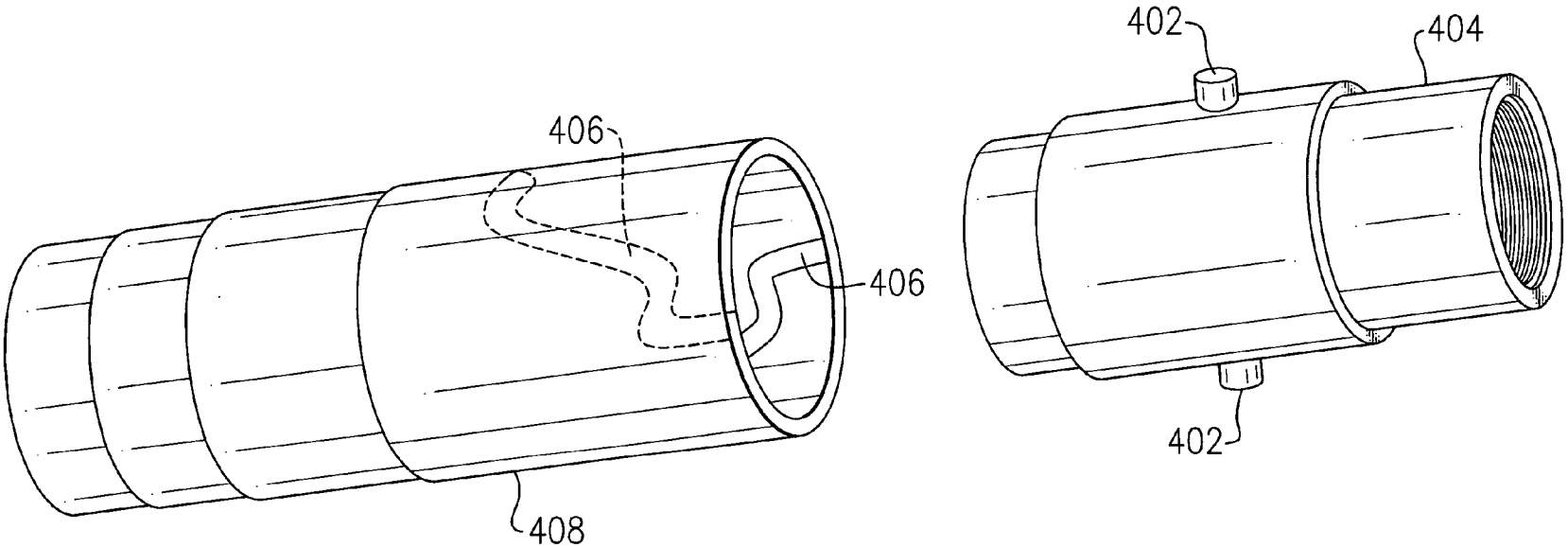
FIG. 10 is an exploded view in perspective of a reverse configuration as compared to FIG. 3, with outward protruding pins attached to an inverse coupling adapter and inverse modified slots attached to an inverse coupling nut.

The creation of a mirror image or other reversal of the teachings herein (i.e., component parts) are certainly possible. For example, it is possible to reverse the position of many relative component parts of the bayonet connector 10 with respect to that as shown or described herein. For example, referring now to FIG. 10, is shown a reversed configuration where inverted outward-protruding pins 402 are attached to an inverted coupling adapter 404 and inverted modified slots 406 are attached to an inside surface of an inverted coupling nut 408. The outward-protruding pins 402 enter into and engage with the inverted modified slots 406, thereby permitting functioning of a "mirror image" version the bayonet connector 10 with similar benefits and capabilities. The inverted modified slots 406 are selected to correspond with any embodiment of the bayonet connector 10, as described herein, or to include any obvious modification, thereof.

It is also possible to include longitudinally offset slots (not shown) that are disposed in a parallel orientation with respect to each other but which are offset along the circumference and which are also offset longitudinally with respect to each other. Of course, modified protruding pins would be included that include a similar longitudinal offset. This would permit engagement of the various modified protruding pins with the various longitudinally offset slots at different times.

If desired, the contour pattern (i.e., the curvature) of at least one initial slot of the longitudinally offset slots (of a special coupling adapter) could be designed to permit insertion of one of the corresponding modified protruding pins therein and subsequent manipulation of the one pin (and of a special coupling nut to which the one pin is attached) along the contour of the initial slot. This can be used to ensure that the one pin must first be urged past an initial curvature pattern in the initial slot, the curvature pattern being similar to that previously described for the various versions of the bayonet connector 10, before any additional engagement occurs. This, in turn, ensures that an initial secure engagement of the special coupling nut to the special coupling adapted will have first occurred before any of the remaining modified protruding pins is able to engage with any of the remaining longitudinally offset slots. Of course, after any of remaining modified protruding pins have engaged with any of remaining longitudinally offset slots, then from that point forward, when continuing to attach the special coupling nut and special coupling adapter together, a remainder of the curvature pattern (i.e., contour) of all of the longitudinally offset slots must be identical so the special coupling nut can be urged in a generally inward direction while it is rotated, as needed, to permit all of the modified protruding pins to follow the remainder of the curvature pattern.

Similarly, the bayonet connector 10 can be modified for use in attaching any desired type of electrical cable directly to a panel (not shown) or directly to an electrical motor (not shown) or directly to any other object, as desired. It is noted that the desired type of electrical cable that is used is a variable which is selected for each particular application and version of the bayonet connector 10 and that each electrical cable that is used with any version of the bayonet connector 10 may vary considerably in size, design, number of wires, gauge of wire, current carrying capacity, voltage rating, or any other parameter from that of the electrical cable 80 that was previously described.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An electrical connector, comprising:

(a) a first half, wherein said first half includes a first half housing and at least one pin attached thereto that includes a portion of said pin that extends inward from an interior of said first half housing, and wherein said first half housing is able to rotate about a center longitudinal axis thereof with respect to a remainder of said first half;

(b) a second half, wherein said second half includes a second half housing that is adapted to cooperate with said first half housing, and wherein said second half housing includes at least one slot disposed on an exterior surface thereof, and wherein said slot includes a predetermined longitudinal length, depth and width whereby said slot is adapted to receive said portion of said pin that extends inward from said interior of said first half housing, and wherein said slot includes a slot opening at a first end thereof into which said pin first enters said slot, and wherein said slot includes a fully engaged slot end that is located at an opposite end of said slot with respect to said slot opening, and wherein said slot includes variation in a direction of contour along said longitudinal length, and wherein said pin, when urged, is able to traverse said longitudinal length from said slot opening to said fully engaged slot end;

(c) means for preventing an unintentional mechanical separation of said first half with respect to said second half from occurring beginning when said pin is disposed at said fully engaged slot end and, wherein, when said pin is urged away from said fully engaged slot end into an intermediate portion of said slot, and wherein said intermediate portion of said slot is disposed intermediate said slot opening and said fully engaged slot end, and wherein said intermediate portion is not disposed at either said slot opening or at said fully engaged slot end, and wherein electrical conductivity is maintained between at least one electrical pin of said electrical connector and at least one electrical socket of said electrical connector when said pin is disposed at said fully engaged slot end;

(d) wherein said means for preventing an unintentional mechanical separation of said first half with respect to said second half includes a first variation in said variation in said direction of contour, and wherein said first variation includes a curvature that, during separation of said first half with respect to said second half, changes a longitudinal traverse direction of said pin and which requires said pin to be urged for a predetermined distance in a first direction that urges said first half closer to said second half, and wherein after said pin has been urged for said predetermined distance in said first direction, said pin must be displaced tangentially a sufficient amount to pass beyond said means for preventing an unintentional separation;

(e) wherein after said pin has been displaced tangentially said sufficient amount, said pin is able to be urged in a second direction, and wherein said second direction urges said first half in a direction that is generally away from said second half, and wherein said pin is able to be urged in said second direction past said slot opening, and wherein when said pin is urged in said second direction past said slot opening, said first half is mechanically separated apart from said second half;

(f) wherein during an urging of said first half away from said second half said pin is being urged in said slot, and wherein when said pin has been urged sufficiently far in said slot and is disposed in said slot immediately prior to said portion of said slot that includes said means for preventing an unintentional mechanical separation of said first half, said pin is being urged generally in said second direction, and wherein a change in the direction that said pin is being urged from said second direction to said first direction, as is required by said means for preventing an unintentional separation of said first half, prevents said unintentional separation from occurring, and wherein when said pin is disposed in said intermediate portion of said slot at said first variation electrical conductivity is severed between all of said electrical pins and all of said electrical sockets, and wherein when said pin is disposed in said intermediate portion of said slot at said first variation and as said pin is continually urged in said slot an amount sufficient to separate said first half apart from said second half no electrical conductivity occurs between any of said electrical pins and any of said electrical sockets; and (g) including means for preventing a propagation of a flame from an interior of said electrical connector from reaching an ambient atmosphere surrounding said electrical connector when said first half is being disconnected from said second half, and wherein said means for preventing said propagation of said flame remains effective until after said first half has been urged in said second direction toward said first variation an amount sufficient to sever all electrical connections between all of said electrical pins and all of said electrical sockets other than an electrical ground that is provided by said electrical connector, and wherein said means for preventing propagation of said flame includes a sufficiently low mechanical tolerance along a potential flame path that said flame could otherwise use to propagate between said interior of said electrical connector to said ambient atmosphere at an exterior of said electrical connector, and wherein said mechanical tolerance is less than an established allowable maximum industry tolerance that is deemed to be sufficient to meet hazardous location approval or flame path protection approval, and wherein said flame path includes a longitudinal length, and wherein said mechanical tolerance along said flame path is sufficient to prevent said propagation of said flame beyond said longitudinal length of said flame path, and wherein said mechanical tolerance along said flame path that is sufficient to prevent said propagation of said flame is maintained until said pin has been urged in said second direction from said fully engaged position to said curvature at said first variation.

2. The electrical connector of claim 1 wherein said pin includes a plurality of pins and wherein said slot includes a plurality of slots.

3. The electrical connector of claim 2 wherein said plurality of pins are disposed in a first spaced-apart relationship with respect to each other, and wherein said plurality of slots are disposed in a second spaced-apart relationship with respect to each other, and wherein each one of said plurality of pins is able to cooperate with a corresponding one of each of said plurality of slots.

4. The electrical connector of claim 3 wherein said plurality of pins includes three pins and wherein said plurality of slots includes three slots.

5. The electrical connector of claim 1, wherein said first half housing includes a skirt, and wherein said skirt includes a generally hollow cylindrical shape that extends longitudinally from said pin that is disposed in said first half in a direction toward said second half, and wherein said skirt maintains said mechanical tolerance at a value that is less than said established allowable maximum industry tolerance until said pin has been urged to said first variation.

6. The electrical connector of claim 5, wherein said second half includes a raised portion, and wherein said slot is disposed in said raised portion, and wherein said raised portion includes an outside diameter that is greater than at any other portion of said housing of said second half, and wherein said outside diameter of said raised portion is uniform for the entire longitudinal length of said raised portion, and wherein said skirt includes an inside diameter that is uniform throughout a longitudinal length of said skirt, and wherein said inside diameter of said skirt is greater than said outside diameter of said raised portion, and wherein said mechanical tolerance sufficient to meet said established allowable maximum industry tolerance for said hazardous location approval or flame path protection approval is provided between said inside diameter of said skirt and said outside diameter of said raised portion when said skirt is disposed over said raised portion.

7. The electrical connector of claim 6, wherein said skirt extends over a portion of said raised portion that is disposed below said fully engaged slot end for a linear distance and wherein said mechanical tolerance where said skirt extends over said portion of said raised portion is sufficient to meet said industry tolerance for said hazardous location approval or flame path protection approval, and wherein said mechanical tolerance over said linear distance that is sufficient to meet said industry tolerance for said hazardous location approval or flame path protection approval is maintained until after said first half has been urged in said second direction said amount sufficient to sever all electrical connections that are provided by said electrical connector.

8. The electrical connector of claim 7, wherein said mechanical tolerance sufficient to meet said industry tolerance for said hazardous location approval or flame path protection approval is provided between said inside diameter of said skirt and said outside diameter of said raised portion when said skirt is disposed over said raised portion, and wherein said mechanical tolerance is maintained until after said first half has been urged in said second direction said amount sufficient to sever all electrical connections that are provided by said electrical connector.

9. The electrical connector of claim 8 wherein said mechanical tolerance sufficient to meet said industry tolerance for said hazardous location approval or flame path protection approval is provided between said inside diameter of said skirt and said outside diameter of said raised portion when said skirt is disposed over said raised portion, and wherein said mechanical tolerance is maintained between said inside diameter of said skirt and said outside diameter of said raised portion for any location therebetween other than for said linear distance.

10. The electrical connector of claim 1 including means for preventing an initial inadvertent separation of said first half from said second half from occurring, and wherein said means for preventing an initial inadvertent separation supplies a force that retains said first half in cooperation with said second half when said pin is disposed at said fully engaged slot end.

11. The electrical connector of claim 10 wherein said means for preventing an initial inadvertent separation from occurring includes providing a generally linear short portion in said slot that extends from said fully engaged slot end around a circumference of said second half and in said first direction, and wherein said force includes a force that is applied intermediate said first half and said second half, and wherein said force urges said first half away from said second half sufficient to urge said pin to said fully engaged slot end when said pin is disposed in said linear short portion, unless a counter force sufficient to overcome said force is applied to said first half.

12. The electrical connector of claim 11 wherein when said first half is fully engaged with said second half, at least one elastomer in said electrical connector is compressed, and wherein said at least one elastomer supplies said force.

13. The electrical connector of claim 1 wherein said electrical connector is suitable for use in a potentially combustible or explosive environment and wherein said electrical connector is able to comply with all of the requirements of a standard governing use of said electrical connector in a hazardous environment or which specifies a level of flame path protection for said electrical connector.

14. The electrical connector of claim 1, a) wherein said slot includes an upper portion and wherein said upper portion includes an upper retentive curved portion and wherein said slot includes a lower portion and wherein said lower portion includes a lower retentive curved portion, and wherein said upper retentive curved portion prevents an unwanted separation of said first half from occurring with respect to said second half when said at least one pin is disposed in a modified third linear portion of said upper portion, and b) wherein said lower retentive curved portion prevents an unwanted separation of said first half from occurring with respect to said second half when said at least one pin is disposed in a lower third linear portion of said lower portion, and wherein said lower retentive curved portion prevents an unwanted loss of said electrical conductivity from occurring between said at least one electrical pin and said at least one electrical socket when said at least one pin is disposed in said lower third linear portion.

15. The electrical connector of claim 1 wherein electrical connectivity between said electrical pin and said electrical socket of said electrical connector is maintained when said pin is disposed in a lower portion of said intermediate portion of said slot.

16. The electrical connector of claim 1 wherein electrical connectivity between said electrical pin and said electrical socket of said electrical connector is severed when said pin is disposed in an upper portion of said intermediate portion of said slot.

17. An electrical connector, comprising:

(a) a first half, wherein said first half includes a first half housing and wherein at least one slot is disposed on an interior surface thereof, and wherein said slot includes a predetermined longitudinal length, depth and width whereby said slot is adapted to receive a portion of at least one pin therein, and wherein said pin extends radially outward from an exterior of a second half housing, and wherein said slot includes a slot opening at a first end thereof into which said pin first enters said slot, and wherein said slot includes a fully engaged slot end that is located at an opposite end of said slot with respect to said slot opening, and wherein said slot includes variation in a direction of contour along said longitudinal length, and wherein said pin, when urged, is able to traverse said longitudinal length from said slot opening to said fully engaged slot end;

(b) and wherein a second half includes said second half housing that is adapted to cooperate with said first half housing;

(c) means for preventing an unintentional mechanical separation of said first half with respect to said second half from occurring beginning when said pin is disposed at said fully engaged slot end and, wherein, when said pin is urged away from said fully engaged slot end into an intermediate portion of said slot, and wherein said intermediate portion of said slot is disposed intermediate said slot opening and said fully engaged slot, end and wherein said intermediate portion is not disposed at either said slot opening or at said fully engaged slot end, and wherein electrical conductivity is maintained between at least one electrical pin of said electrical connector and at least one electrical socket of said electrical connector when said pin is disposed at said fully engaged slot end;

(d) wherein said means for preventing an unintentional mechanical separation of said first half with respect to said second half includes a first variation in said variation in said direction of contour, and wherein said first variation includes a curvature that, during separation of said first half with respect to said second half, changes a longitudinal traverse direction of said pin and which requires said pin to be urged for a predetermined distance in a first direction that urges said first half closer to said second half, and wherein after said pin has been urged for said predetermined distance in said first direction, said pin must be displaced tangentially a sufficient amount to pass beyond said means for preventing an unintentional separation;

(e) wherein after said pin has been displaced tangentially said sufficient amount, said pin is able to be urged in a second direction, and wherein said second direction urges said first half away from said second half, and wherein said pin is able to be urged in said second direction past said slot opening, and wherein when said pin is urged in said second direction past said slot opening, said first half is mechanically separated apart from said second half;

(f) wherein during an urging of said first half away from said second half said pin is being urged in said slot, and wherein when said pin has been urged sufficiently far in said slot and is disposed in said slot immediately prior to said portion of said slot that includes said means for preventing an unintentional mechanical separation of said first half, said pin is being urged generally in said second direction, and wherein a change in the direction that said pin is being urged from said second direction to said first direction, as is required by said means for preventing an unintentional separation of said first half, prevents said unintentional separation from occurring, and wherein when said pin is disposed in said intermediate portion of said slot at said first variation electrical conductivity is severed between all of said electrical pins and all of said electrical sockets, and wherein when said pin is disposed in said intermediate portion of said slot at said first variation and as said pin is continually urged in said slot an amount sufficient to separate said first half apart from said second half no electrical conductivity occurs between any of said electrical pins and any of said electrical sockets; and (g) including means for preventing a propagation of a flame from an interior of said electrical connector from reaching an ambient atmosphere surrounding said electrical connector when said first half is being disconnected from said second half, and wherein said means for preventing said propagation of said flame remains effective until after said first half has been urged in said second direction toward said first variation an amount sufficient to sever all electrical connections between all of aid electrical pins and all of said electrical sockets other than an electrical ground that is provided by said electrical connector, and wherein said means for preventing propagation of said flame includes a sufficiently low mechanical tolerance along a potential flame path that said flame could otherwise use to propagate between said interior of said electrical connector to said ambient atmosphere at an exterior of said electrical connector, and wherein said mechanical tolerance is less than an established allowable maximum industry tolerance that is deemed to be sufficient to meet hazardous location approval or flame path protection approval, and wherein said flame path includes a longitudinal length, and wherein said mechanical tolerance along said flame path is sufficient to prevent said propagation of said flame beyond said longitudinal length of said flame path.

18. An electrical connector, comprising:

(a) a first half, wherein said first half includes a first half housing and at least one pin attached thereto that includes a portion of said pin that extends inward from an interior of said first half housing, and wherein said first half housing is able to rotate about a center longitudinal axis thereof with respect to a remainder of said first half;

(b) a second half, wherein said second half includes a second half housing that is adapted to cooperate with said first half housing, and wherein said second half housing includes at least one slot disposed on an exterior surface thereof, and wherein said slot includes a predetermined longitudinal length, depth and width whereby said slot is adapted to receive said portion of said pin that extends inward from said interior of said first half housing, and wherein said slot includes a slot opening at a first end thereof into which said pin first enters said slot, and wherein said slot includes a fully engaged slot end that is located at an opposite end of said slot with respect to said slot opening, and wherein said pin, when urged, is able to traverse said longitudinal length from said slot opening to said fully engaged slot end;

(c) means for preventing an unintentional mechanical separation of said first half with respect to said second half from occurring beginning when said pin is disposed at said fully engaged slot end and, wherein, when said pin is urged away from said fully engaged slot end into an intermediate portion of said slot, and wherein said intermediate portion of said slot is disposed intermediate said slot opening and said fully engaged slot end, and wherein said intermediate portion is not disposed at either said slot opening or at said fully engaged slot end, and wherein electrical conductivity is maintained between at least one electrical pin of said electrical connector and at least one electrical socket of said electrical connector when said pin is disposed at said fully engaged slot end;

(d) wherein said means for preventing an unintentional mechanical separation includes a generally S-shaped curvature portion of said slot that is disposed intermediate said fully engaged slot end and said slot opening, and wherein said slot includes a linear section that extends from said S-shaped curvature portion to said slot opening, and wherein said linear section is in parallel alignment with a longitudinal axis of said second half;

(e) wherein said electrical conductivity is maintained between said at least one electrical pin and said at least one electrical socket when said pin is disposed at said fully engaged slot end up until when said pin has been urged in said slot an amount sufficient for said pin to pass from said fully engaged slot end and reach a beginning portion of said S-shaped curvature portion that is disposed proximate said fully engaged slot end, and wherein said electrical conductivity between said at least one electrical pin and said at least one electrical socket is severed at a predetermined location when said pin reaches said beginning portion of said S-shaped curvature portion and wherein no electrical conductivity occurs between said at least one electrical pin and said at least one electrical socket when said pin is urged from said beginning portion of said S-shaped curvature portion through said S-shaped curvature portion and through said linear section to said slot opening; and (f) including means for preventing a propagation of a flame from an interior of said electrical connector from reaching an ambient atmosphere surrounding said electrical connector when said first half is being disconnected from said second half, and wherein said means for preventing said propagation of said flame remains effective until after said first half is urged in said second direction an amount sufficient to sever all electrical connections other than electrical ground that are provided by said electrical connector, and wherein said means for preventing said propagation of said flame remains effective until after said pin has reached said beginning portion of said S-shaped curvature portion, and wherein said means for preventing propagation of said flame includes a sufficiently low mechanical tolerance along a potential flame path that said flame could otherwise use to propagate between said interior of said electrical connector to said ambient atmosphere at an exterior of said electrical connector, and wherein said mechanical tolerance is less than an established allowable maximum industry tolerance that is deemed to be sufficient to meet hazardous location approval or flame path protection approval, and wherein said flame path includes a longitudinal length, and wherein said mechanical tolerance along said flame path is sufficient to prevent said propagation of said flame beyond said longitudinal length of said flame path;

(g) and wherein said first half housing includes a skirt, and wherein said skirt includes a generally hollow cylindrical shape that extends longitudinally from said pin that is disposed in said first half in a direction toward said second half, and wherein said skirt maintains said mechanical tolerance at a value that is less than said established allowable maximum industry tolerance until said pin has been urged to said beginning portion of said S-shaped curvature portion;

(h) and wherein said S-shaped curvature portion prevents an unintentional mechanical separation of said first half with respect to said second half from occurring when said pin is disposed at said fully engaged position until said pin has been urged in a first direction away from said fully engaged position to said beginning portion of said S-shaped curvature, and wherein said S-shaped curvature prevents said pin from being further urged only in said first direction an amount sufficient to cause said unintentional mechanical separation of said first half from said second half, and wherein to accomplish an intentional mechanical separation of said first half from said second half said pin must be urged along a portion of said S-shaped curvature in a direction that is generally opposite that of said first direction before said pin can again be urged in said first direction an amount sufficient to separate said first half from said second half.

* * * * *